US011390442B2

(12) United States Patent
Nini

(10) Patent No.: US 11,390,442 B2
(45) Date of Patent: Jul. 19, 2022

(54) DELIVERING TAP EQUIPPED WITH INTERNAL SILICONE VALVE WITH AUTOMATIC CLOSURE WITH MULTIPLE LIQUID-SEALING AND TAMPER-PREVENTING SYSTEMS

(71) Applicant: VITOP MOULDING S.R.L., Alessandria (IT)

(72) Inventor: Diego Nini, Alessandria (IT)

(73) Assignee: VITOP MOULDING S.R.L., Alessandria (IT)

( * ) Notice: Subject to any disclaimer, the term of this patent is extended or adjusted under 35 U.S.C. 154(b) by 74 days.

(21) Appl. No.: 16/766,272

(22) PCT Filed: Oct. 26, 2018

(86) PCT No.: PCT/IT2018/000142
§ 371 (c)(1),
(2) Date: May 21, 2020

(87) PCT Pub. No.: WO2019/111285
PCT Pub. Date: Jun. 13, 2019

(65) Prior Publication Data

US 2020/0369449 A1 Nov. 26, 2020

(30) Foreign Application Priority Data

Dec. 6, 2017 (IT) ..... 102017000140741

(51) Int. Cl.
*B65D 77/06* (2006.01)
*B67D 3/04* (2006.01)
(Continued)

(52) U.S. Cl.
CPC ..... *B65D 77/067* (2013.01); *B67D 3/043* (2013.01); *B65D 41/205* (2013.01);
(Continued)

(58) Field of Classification Search
CPC ..... B65D 77/067; B65D 77/068; B65D 2401/10; B65D 41/205; B67D 2001/0827; B67D 3/043
See application file for complete search history.

(56) References Cited

U.S. PATENT DOCUMENTS 4,619,377 A * 10/1986 Roos ..... B67B 7/26 222/129
5,531,363 A * 7/1996 Gross ..... B65D 47/2031 222/494

(Continued)

FOREIGN PATENT DOCUMENTS

WO 9858847 A1 12/1998
WO 2016051276 A2 4/2016

*Primary Examiner* — Frederick C Nicolas
(74) *Attorney, Agent, or Firm* — Maschoff Brennan

(57) ABSTRACT

A tap is described for delivering liquids from a container: including: a main body to be placed at the delivery end of the container; a valve inserted between a lower fastening body and the main body, which includes slits to ensure the air-tightness allowing liquids to pass only when opening the tap; the lower fastening body to be placed on the delivery end of the container; and an upper plug placed over the main body; the main body includes a tamper evident warranty ring integrated and removable when first opening the tap; and the upper plug is assembled on the main body and anchored to the warranty ring integrated in the main body.

11 Claims, 35 Drawing Sheets

(51) Int. Cl.
*B65D 41/20* (2006.01)
*B67D 1/08* (2006.01)

(52) U.S. Cl.
CPC ..... *B65D 77/068* (2013.01); *B65D 2401/10* (2020.05); *B67D 2001/0827* (2013.01)

(56) References Cited

U.S. PATENT DOCUMENTS 5,632,420 A * 5/1997 Lohrman ..... B65D 47/0838 222/212
5,680,969 A * 10/1997 Gross ..... B65D 47/242 222/494
5,897,033 A * 4/1999 Okawa ..... B65D 47/2031 222/212
6,089,418 A * 7/2000 Gaiser ..... B65D 47/2031 222/490
6,401,982 B1 * 6/2002 Grittmann ..... B67D 3/04 222/153.05
6,910,607 B2 * 6/2005 Gaiser ..... B65D 47/2031 222/212
7,077,294 B2 * 7/2006 Nusbaum ..... B65D 47/283 222/153.06
10,508,015 B2 * 12/2019 Nini ..... B67D 3/042
10,604,401 B2 * 3/2020 Nini ..... B67D 3/043

* cited by examiner

DELIVERING TAP EQUIPPED WITH INTERNAL SILICONE VALVE WITH AUTOMATIC CLOSURE WITH MULTIPLE LIQUID-SEALING AND TAMPER-PREVENTING SYSTEMS

BACKGROUND OF THE INVENTION

1) Field of the Invention

The present invention refers to a delivering tap of liquids from containers, in particular the so-called containers of the "bag-in-box" type (herein below also called BIB).

2) Background Art

A feature of the present invention is devising a tap which is completely made of plastic material (therefore, easily recyclable) and which is configured for various systems (dispensers) nowadays present on the market, actually replacing the old tap versions which are currently marketed, providing a product which guarantees more protection for the product, both in terms of seal to liquids, and in terms of tamper prevention of the product itself, which is a very important item nowadays.

Some prior art tap configurations are known, which use a technology composed of silicone valves with self-closure and self-seal to liquids: they have been on the market for several years and are, for example, self-closing valves manufactured by US Company Liquid Molding Systems Inc., which is the first instance of this product meant as flexible, self-closing silicone valve.

There are several manufacturers of self-closing silicone valves like the one manufactured by LMS Inc. (with small geometric differences), which can be used as part of the tap described below, but which will not be mentioned here (for example, companies Vernay, Mini Valve, etc.).

Document WO-A1-98/58847 discloses a tap according to the preamble of Claim 1.

Object of the present invention is providing a tap which uses one of these silicone valves present on the market, and provides the end user with a delivering tap which contains this silicone valve technology, but has better guarantees and/or advantages, with respect to already known taps, regarding liquid seal (when the tap is closed in its storage and/or transport position) and also more guarantees that the liquids inside the container (preferably BIB) have not been tampered with and/or polluted, two to the multiple tamper-preventing systems present on the various components of the tap.

Currently, the manufacturers of closures present on the market and which contain therein flexible silicone valves are three:

Scholle IPN;

Rapak (part of the DS Smith Packaging Group);

Liqui-Box.

The first two manufacturers use as "core" of the system the silicone valve manufactured by company LMS Inc. (or similar, self-produced ones), as can be seen in FIG. 21, while company Liqui-Box uses a different valve (model "Duckbill Valve" always made of silicone) with a system integrated therein to guarantee its best self-closure, since this silicone valve alone does not guarantee a perfect self-closure and liquid seal, which instead is provided by the valve used by the first two companies.

All three companies have filed patent applications, as follows:

1. Scholle IPN: WO2010/047814
2. Rapak: WO2016051276
3. Liqui-box: WO2013033135.

As regards the front valve of FIG. 21, it can be noted that main body and upper closing tap have been obtained on the same piece (through a flap-type system), and therefore will necessarily be produced with the same material. This will not provide advantages in terms of tap seal when the tap is in its closure/transport position, since the necessary conditions to obtain an optimum seal cannot be reached, which instead, as described below, are obtained with the tap of the present invention, comprising a main body and an upper plug, which firstly allow creating two components with different materials (a soft one and a hard one), which are the base for having a perfect seal between two plastic components, and further allow obtaining the optimum sealing geometries on the two different components.

With respect to the existing tap manufactured by company Rapak, which is composed of different, mutually divided parts (in particular it comprises three components plus the silicone valve LMS which is common to all three taps, and namely main body, fastening ring and small closing/sealing plug for the tap), the tap of the invention allows adding a tamper evident system, capable of pointing out the first opening, which the Rapak tap has not.

In all known taps, once having removed the main upper tap, which keeps the system closed before its first opening, one relies upon the sealing of the silicone valve only, which, as known, is deemed of the "normally open" type, since it is produced with through cuts to guarantee the chance of being opened by darts or dilating pins (which will be better described below); therefore, a small counter-pressure coming from inside the container (in this case BIB) is enough to make the liquid blows-by from the slits (notches created ad hoc during the step of manufacturing the silicone valve) present on the silicone valve and a liquid leakage occurs. This type of valves rely, for their seal to liquids, to walls vertically created in the notches, performing the seal also due to the used material (namely soft silicone). The third tap analyzed (manufactured by company Liqui-box), instead, once having removed the upper plug, has a valve of the Duckbill model which, as known, has still more sealing problems, so that it will have still more sealing problems, so that, to enable the liquid seal, a particular spring component has been added, which helps keeping closed the edges of the Duckbill valve, which otherwise would not be able alone to guarantee a perfect liquid seal.

Therefore, in none of the three currently marketed taps, which use this technology with silicone valve, there is no device which allows keeping the tap completely sealed, till its first opening, in a sure and safe way.

Moreover, there is no tap (with two different parts) which has a tamper evident system, which provides evidence of the first opening and allows the end user to see if possibly the tap has been tampered with before its first use.

Still more, the plugs which are placed on the upper part of the delivering tap (to seal the system) sometimes are not able to guarantee an optimum liquid seal, and also to pass the test which then determines that the delivering device is aseptic or not (namely, the 0.5 bar pressure test).

SUMMARY OF THE INVENTION

As will be described below in more detail, in the delivering tap of the invention, a system with flap (optional) is inserted on the lower part of the tap, which remains closed and sealed till the delivering pin of the systems present on the market (quick connection systems present on automatic and non-automatic dispensers, which are dilated, and therefore open the silicone valve) do not open the system with total safety during the automatic penetration step.

Moreover, by sealing the system also from its lower part, a seal is provided for the 0.5 bar pressure test to obtain the requirements of aseptic seal, which currently the other delivering devices not always are capable to guarantee with 100%.

Still more, the system with flap of the invention has its main feature, due to its arrangement, of increasing the liquid seal in case of counter-pressure, since this latter one pushes the tap under seal still more.

On delivering taps manufactured by companies Rapak and Liqui-box, the system (tap) can be opened and closed without the end user becoming aware of the performed opening.

On the delivering tap of the invention, instead, there are two different tamper evident systems, which provide evidence of a possible opening to the consumer, the first which occurs once having assembled the two components, and the other with systems with jumpers which will be described below in detail.

If the rear sealing system with flap is then also taken into account, a tap according to the invention is obtained, which, in addition to the two tamper evident systems, is also equipped with a counterfeit-preventing system, since the flap will be opened only and exclusively upon the first opening for delivering, and then it will be impossible to close it again by possible counterfeiters, making it thereby unique on the market.

Moreover, the tap of the invention allows making a delivering device which allows having a very high oxygen barrier and, as described below, this feature will be obtained also due to the counterfeit-preventing system with flap present on the back of the tap.

A further object of the present invention is providing a simple and eco-compatible tap which however allows adapting to systems present on the market, not requiring their modification.

The tap of the invention is able to be adapted without problems to all versions of delivering pins present on the market. Herein below, the known solutions present on the market will be described, more specifically those of Taylor and Carpigiani dispensing devices.

Analyzing the opening steps of the three delivering devices present on the market, the following can be summarized:

Step 1: opening/removing the protecting tap. In this case, only the Scholle delivering device is equipped with a tamper evident, which strongly and indisputably points out the opening;

Step 2: as regards the Scholle and Liqui-box delivering devices, the opening of the protecting flap must be performed, the flap being obtained in a single piece with the main body. From this step on, one relies upon the sealing of the silicone valve which, as previously stated, could be opened due to a pressure on the container;

Step 3: inserting the container on the delivering machines (usually, the machines manufactured both by company Taylor and by company Carpigiani are equipped with a removable tray, where the mouth is fastened (in case of a BIB) in the suitable seat. In this case, by handling for example the bag (in case of BIB), one could create the pressure capable of opening the silicone valve and generating a liquid leakage;

Step 4: inserting the delivering pin of the machine in the delivering tap and opening the silicone valve with following delivery of the product contained in the container;

Step 5: removing/changing the container and starting again from Step 1.

A further object of the present invention is providing a tap as described above, which performs a perfect liquid seal and a proof of the aseptic test, guaranteeing a perfect seal when the tap is in its closing and/or transport position and till the upper plug has been removed due to the use of different materials and correct geometries of the components.

A further object is providing tamper evident and counterfeit-preventing systems which provide evidence of the removal of the upper plug due, as will be described below, to the cooperation of various geometries once having assembled the tap.

A further object is providing the customer with the chance of choosing to have a further counterfeit-preventing system (optional) which protects the contents of the container (in this case BIB) till the delivering tap is opened by the delivering pin of the liquid distribution machine, due to the integrated system with flap integrated, and therefore one does not rely any more, as occurs with the other delivering taps present on the market, only on the seal of the upper plug and of the silicone valve once having removed/opened the upper tap/flap, but also this additional and optional system with flap will be used.

A further object is creating a delivering device where all components are placed in the rear part of the delivering device, thereby obtaining a strong decrease of oxygen which enters in the bag (in case of use of a BIB container), since the space which is normally occupied by air will be occupied by the components forming the tap.

A further object of the present invention is constraining two components due to different technologies. The main one is screwing (which can also have its version with flap, not shown), where the necessary geometries are made, useful for a stable screwing of the two components, and for blocking them to avoid their unscrewing.

Moreover, an object of the present invention is making a tap which allows stably constraining the rear component with flap (or without flap) to the tap body due to the use of innovative welding technologies between two components (laser or ultrasound), in order to obtain a single piece which stably contains the silicone valve.

A further object of the present invention is providing a tap which allows stably constraining the rear component with flap (or without flap) to the tap body exploiting the threading, which will be described below in detail, in order to create a single piece which stably contains the silicone valve and allows applying a sealing force for compressing an upper and lower flange of the silicone valve.

A further object of the present invention is designing a rear sealing mechanism which allows having an oxygen barrier increase, optional, if this additional guarantee is required for specific needs.

Moreover, there will be a strong decrease of the amount of oxygen inside the bag once having finished to fill it, since all system members are housed on the back of the tap with respect to the delivery area, thereby occupying the volume which is normally free and therefore full of air, like in known taps on the market.

A further object of the present invention is providing a tap as mentioned above, which is equipped with warranty seal of the tamper evident type, both on the upper plug and, above all, on the main body. When the tap is assembled, the upper plug is fastened to the ring present on the body and creates a double sealing, counterfeit-preventing and tamper evident system, which will irreversibly show its opening once having opened it, and will keep the components in place during the various manufacturing steps, when it is in its closing phase.

The inventive tap, being provided with a high oxygen barrier, is suitable for aseptic applications.

A further object of the present invention is providing a tap with a plug which is equipped with two handles to enable the first opening and the removal, which will however remain plate when handling the product and removing/inserting during its filling phase.

A further object of the present invention is providing the delivering tap of a counterfeit-preventing system with flap integrated on the delivering device, which allows the opening only once (upon the first delivery) and above all does not allow a new closing by possible counterfeiters, thereby guaranteeing product, manufacture and consumer at 100%. As already explained previously, this is an optional feature which the customer can choose as additional guarantee.

A further object of the present invention is creating parts which are easy to make when molding, and easy to assemble, in order to reduce the manufacturing costs to a minimum.

The above and other objects and advantages of the invention, as will result from the following description are obtained with a delivering tap as claimed in Claim 1. Preferred embodiments and non-trivial variations of the present invention are the subject matter of the dependent claims.

BRIEF DESCRIPTION OF THE DRAWINGS

The present invention will be better described by some preferred embodiments thereof, provided as a non-limiting example, with reference to the enclosed drawing, in which.

DETAILED DESCRIPTION OF PREFERRED EMBODIMENTS

With reference to the Figures, different embodiments, as non-limiting example, of the delivering tap 1 of the invention will be shows and described.

Two embodiments of the tap 1 of the invention will be described, depending on the method used for performing a permanent fastening between a main body 3, 11 and a lower body 4, 6, 12, described below in more detail, and namely through welding or through screwing (which will be the main and preferred configuration).

Moreover, the two embodiments will in turn be divided into a first base version of the lower body (obtained both through fastening by screwing, and through fastening by welding) and a second version of the lower body comprising an integrated tamper-preventing flap (obtained both through fastening by screwing (not shown) and through fastening by welding).

Figure 17:
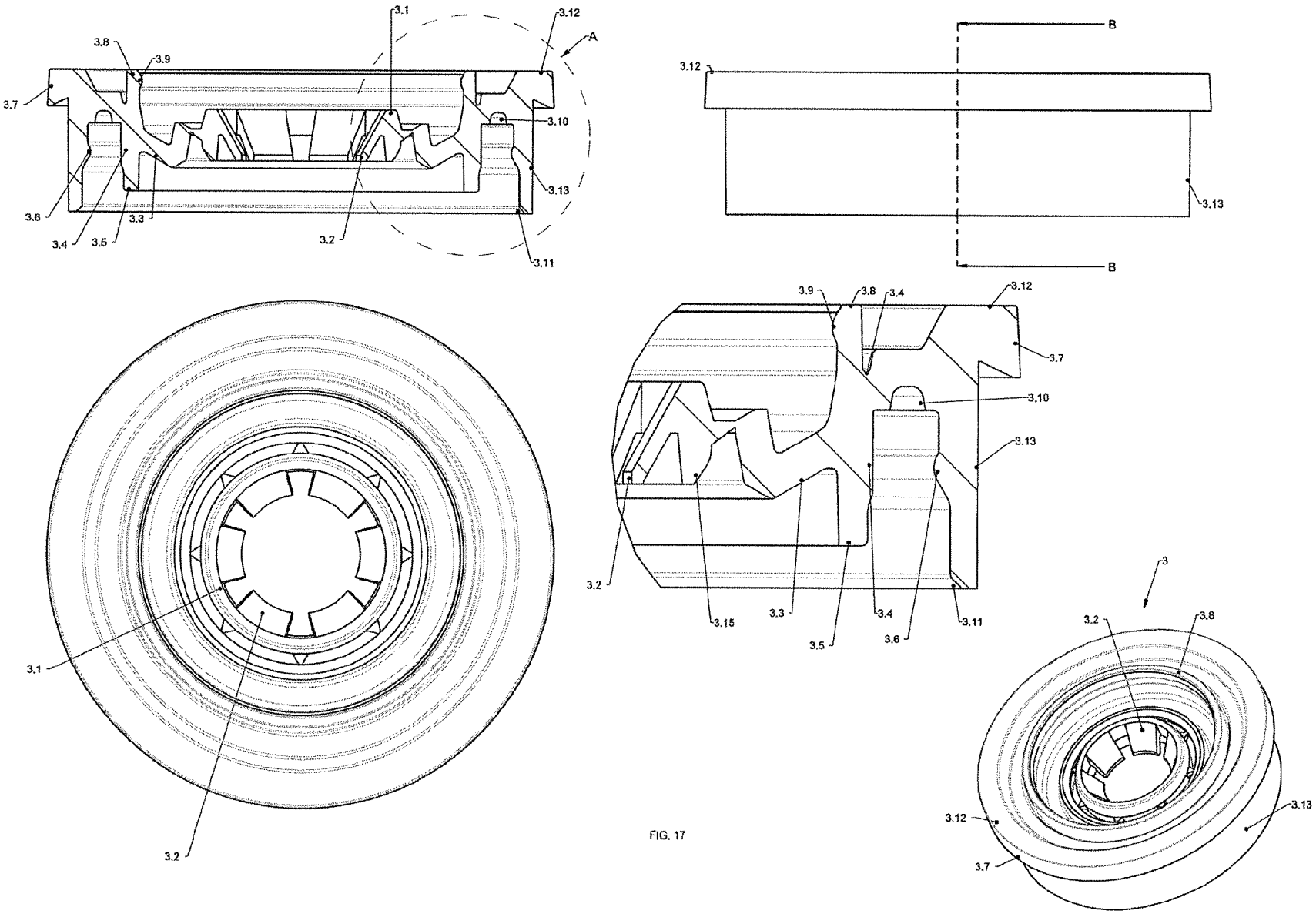
FIG. 17 is a series of views of the body of the inventive tap.
Figure 19:
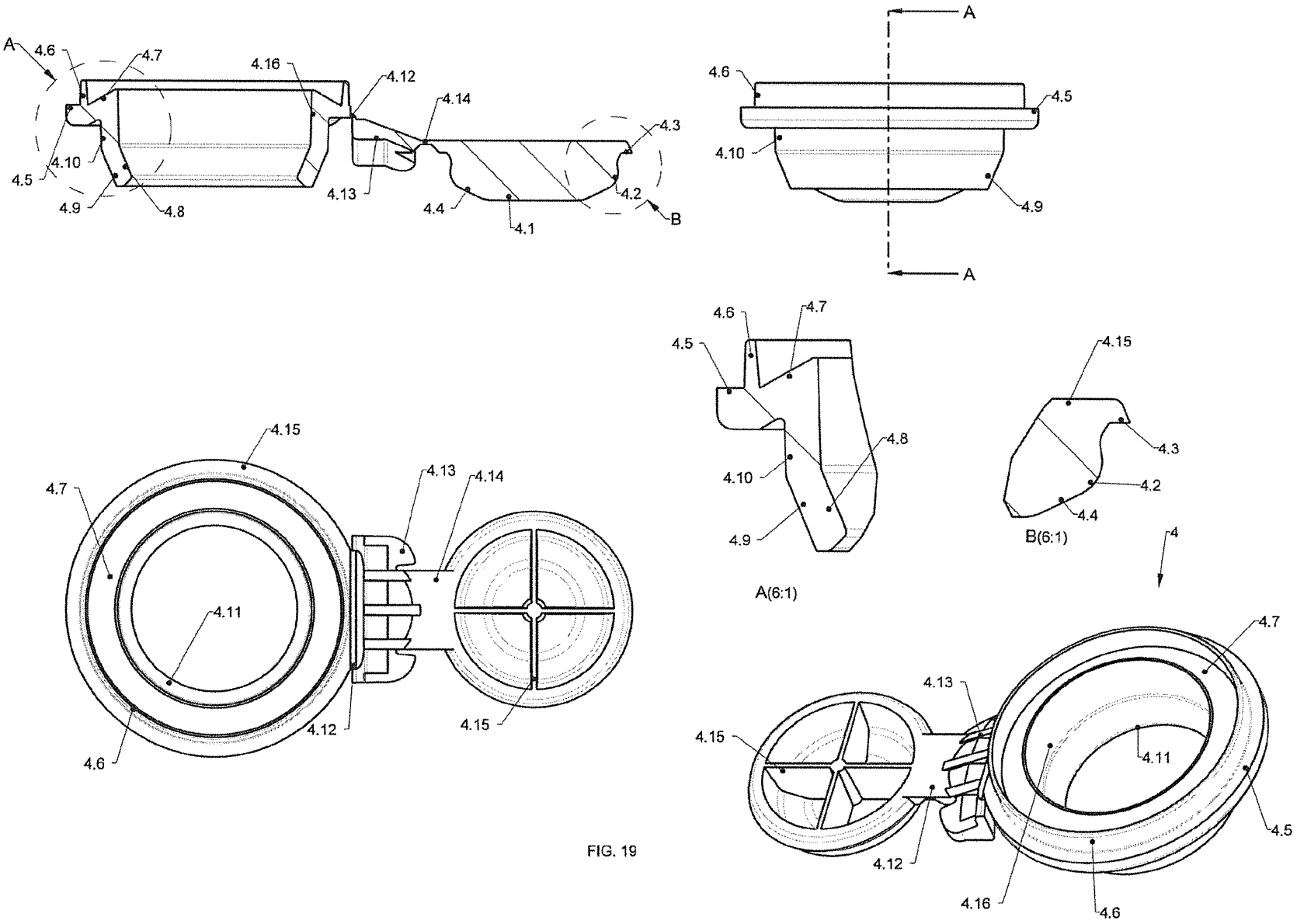
FIG. 19 is a series of views of the lower part of the tap with counterfeit-preventing seal with integrated flap shown in an open molding position of the inventive tap.
Figure 20:
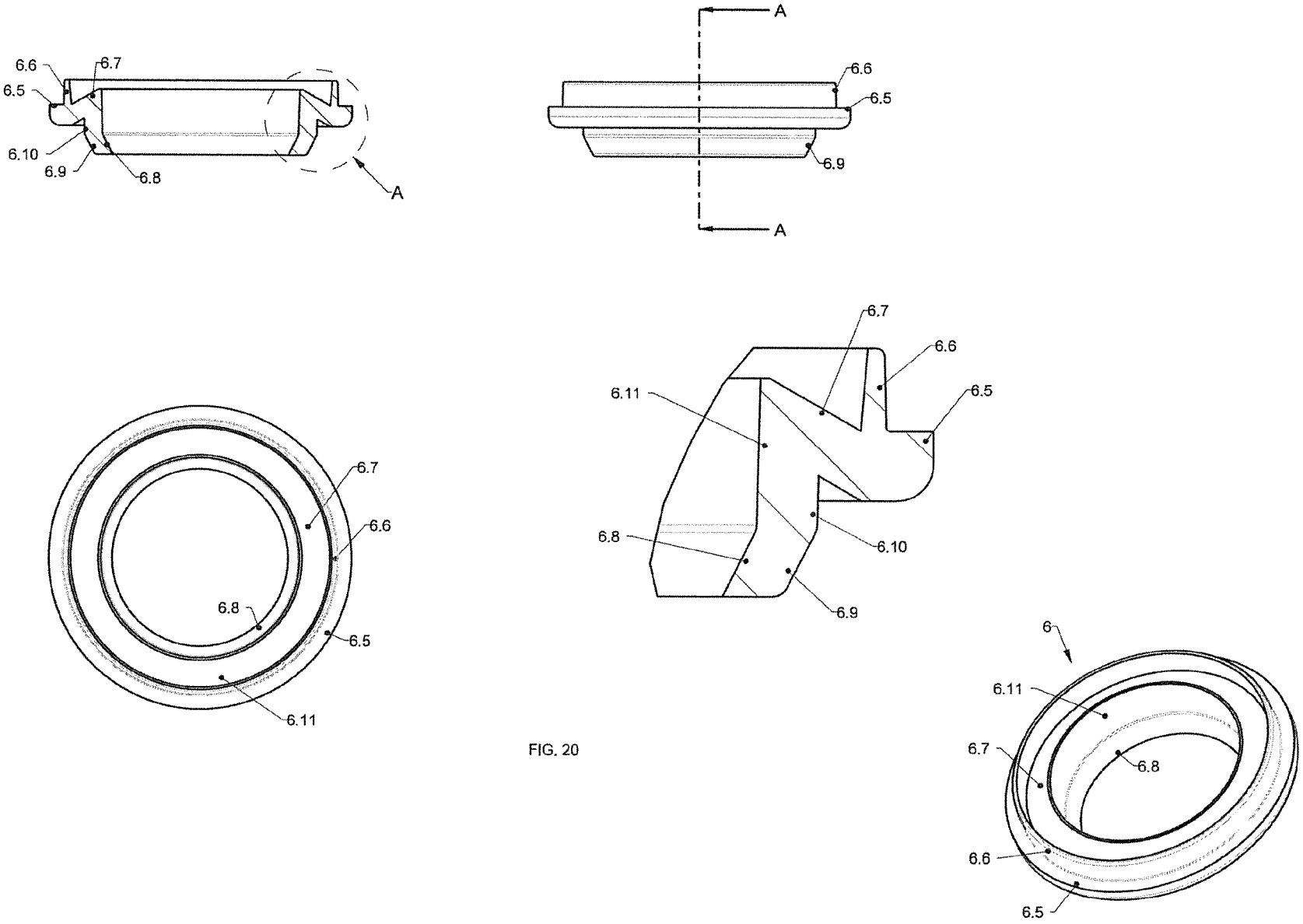
FIG. 20 is a series of views and sections of the lower part in its version without the anti-counterfeiting closure flap, in order to give the end customer the chance of choosing which version to purchase.
Figure 30:
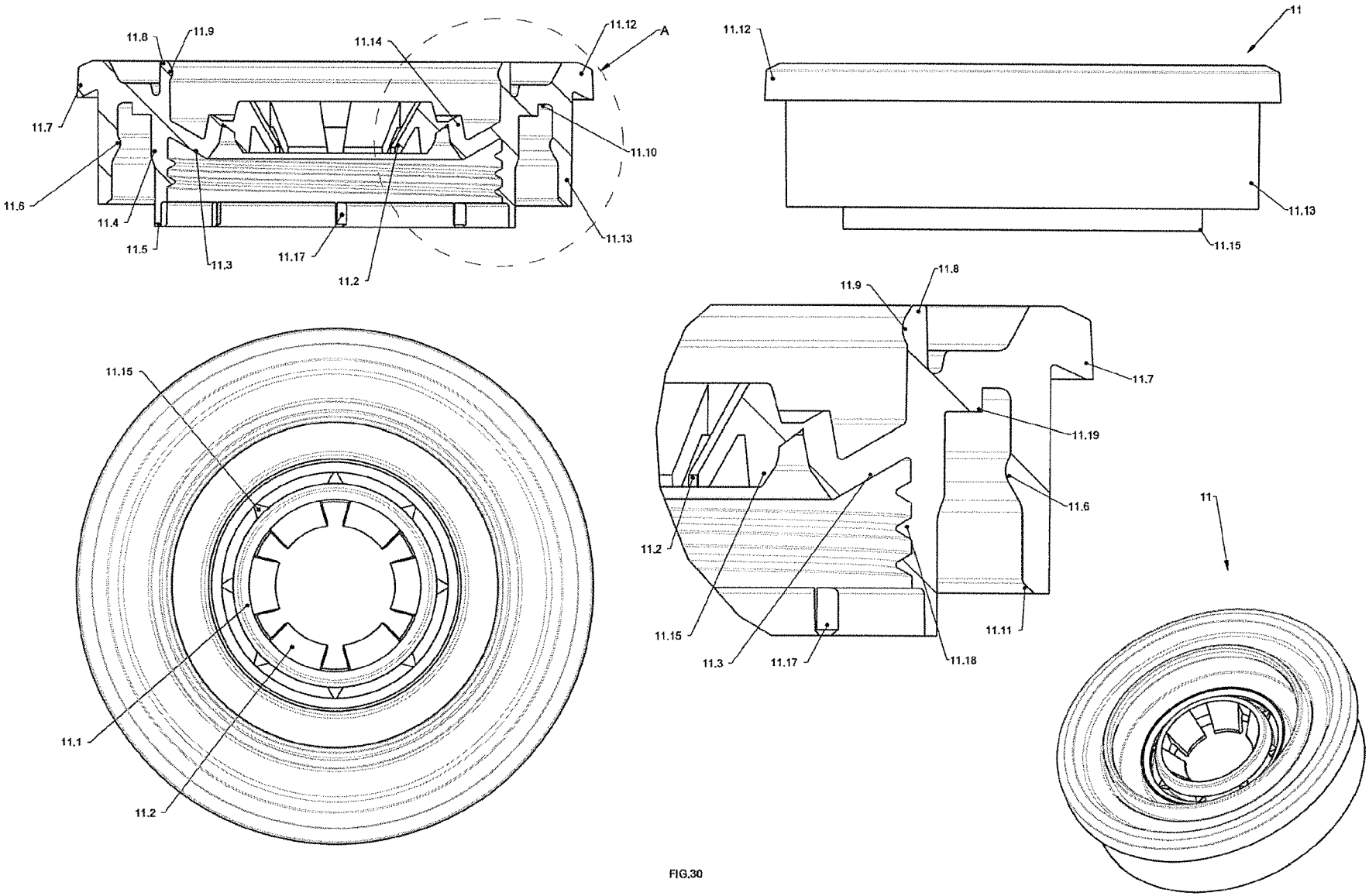
FIG. 30 is a series of views of a part of an embodiment of the tap according to the present invention.
Figure 31:
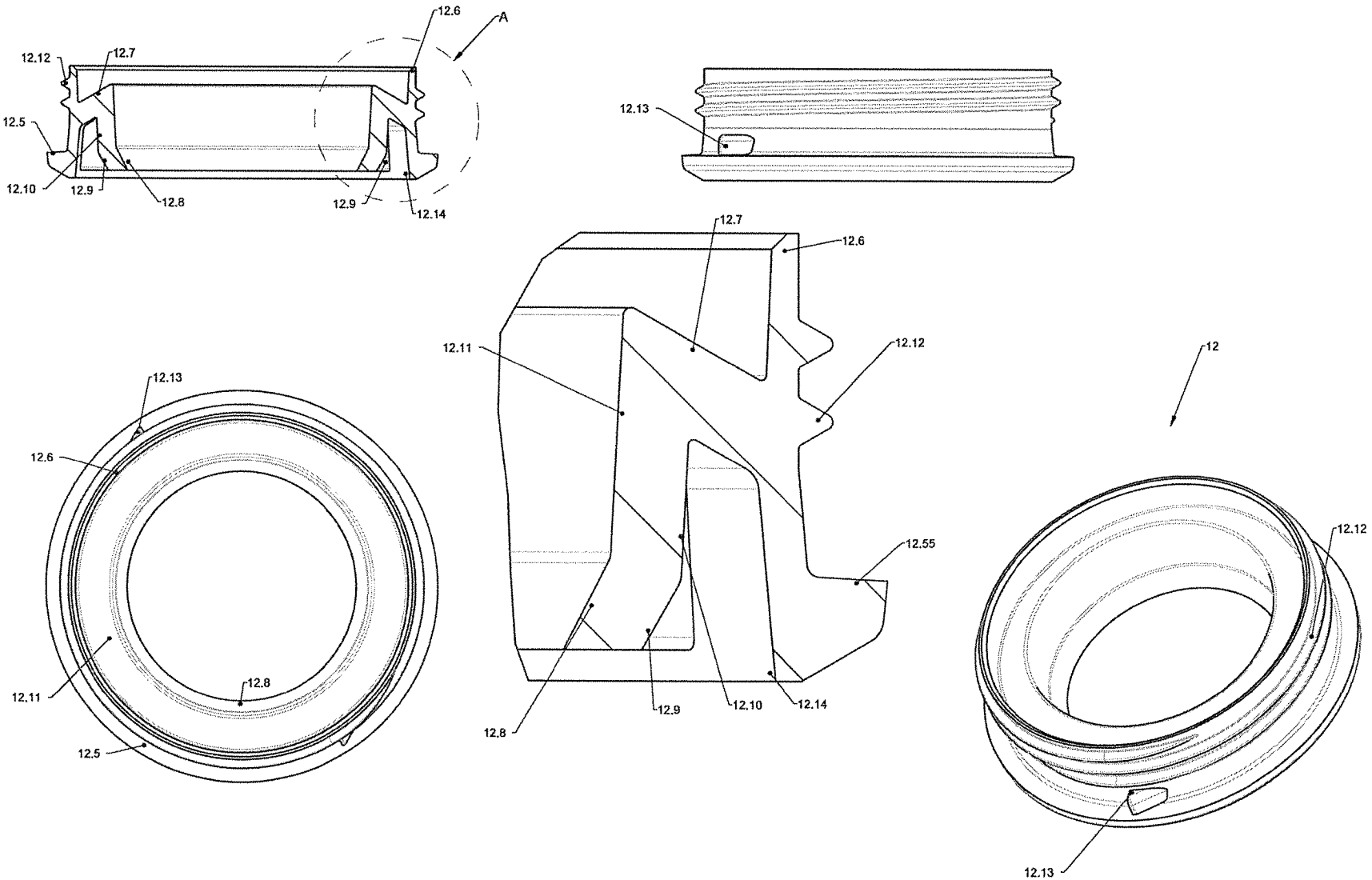
FIG. 31 is a series of views of a part of another embodiment of the tap according to the present invention.

Summarizing, four embodiments will be described of the tap 1 for delivering liquids of the invention, resulting from the coupling of the components listed below:

- the main body 11, shown in FIG. 30, to be coupled through screwing with one of the two following components:
- lower fastening body 12 with screwing, without tamper-preventing flap, shown in FIG. 31;
- lower fastening body with screwing with tamper-preventing flap (not shown in the Figures);
- the main body 3, shown in FIG. 17, to be coupled through welding with one of the two following components:
- lower fastening body 6 for welding, without tamper-preventing flap, shown in FIG. 20;
- lower fastening body 4 for welding with integrated counterfeit-preventing flap 4.1, shown in FIG. 19.

It will be clear for a skilled person in the art that the described tap can be made with different shapes, sizes and with equivalent parts, and could be used for various types of containers, for example the so-called "Bag-in-Boxes", but also those of a rigid or semi-rigid type or others.

The tap 1 of the invention is used for delivering liquids from a container (not shown), and substantially comprises:

- the main body 3, 11 equipped with an integrated central warranty (tamper evident) ring/seal 3.1, 11.1 and configured to be placed at the delivery end of the container (being it rigid, semi rigid or flexible, of the Bag-in-Box type) (not shown);
- a valve 5, preferably made of silicone, (already present on the market and therefore to be purchases apart), for example of the known rtype manufactured by company LMS;
- the lower fastening body 4, 6, 12, which can be configured according two embodiments, depending whether it has to be fastened to the main body 3, 11 through welding (lower fastening body 4, 6 shown in FIGS. 19 and 20) or through screwing (lower fastening body 12 shown in FIG. 31).

The lower fastening body 4, 6 with profile 4.5, 6.5 useful for welding on the main body 3 can in turn be configured in two embodiments, depending whether it comprises or not the additional anti-counterfeiting warranty; the configuration with lower fastening body 4 with integrated counterfeit-preventing flap 4.1 (which will be described below in detail) and the configuration 6 without integrated flap. Its purpose is blocking the silicon valve 5, inserted between the lower fastening body 4 and the main body 3, and allow its correct opening.

The lower fastening body 12, comprising a threading 12.12 for screwing with a threading 11.18 obtained on the main body 11, can in turn be configured in two embodiments, depending whether it comprises or not the additional anti-counterfeiting warranty, and namely the version with lower fastening body 12 of FIG. 31 without integrated flap, and the version with integrated counterfeit-preventing flap (not shown in the Figures, but also being part of an embodiment of the invention). Their purpose, as for the previously described version, is blocking the valve 5, inserted between the lower fastening body 12 and the main body 11, and allow its correct opening.

The inventive tap 1 further comprises an upper plug or cap 2, 7, 10, preferably with integrated warranty seal and flexible handles, for its easy removal when first opening it, which is used to create the tamper evident system (once assembled on the main body 3, 11 and fastened to the tamper evident ring 3.1, 11.1 integrated in the body 3, 11.

In its main configuration, shown in FIGS. 25 to 35, also going in detail, the section of the inventive tap 1 assembled and in its closing and transport position can be seen in its preferred embodiment.

Figure 21:
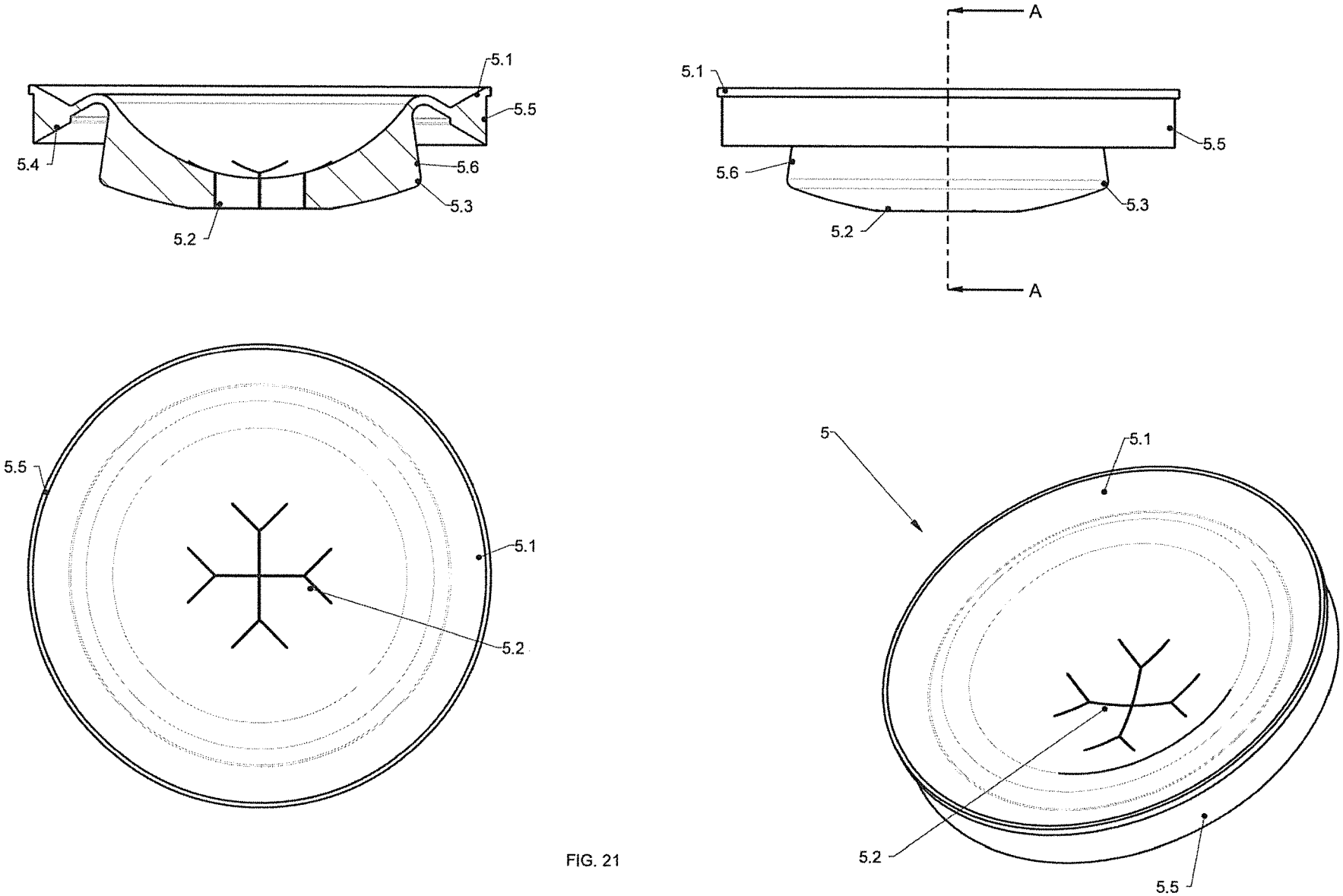
FIG. 21 is a series of views of the silicone valve nowadays present on the market.
Figure 27:
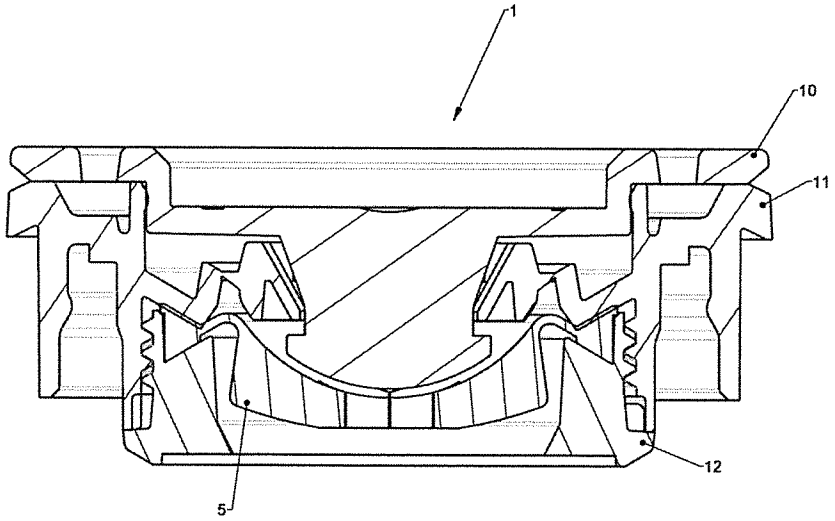
FIG. 27 is a side sectional view of the assembled tap of FIG. 1 in its completely closed position.

In particular, with reference to FIG. 27 where the inventive tap 1 is shown in section and in its closing position, it can be noted that the valve 5, preferably made of silicone, is inserted into a circular seat 11.3 (FIG. 30), obtained in the lower part of the tamper evident ring 11.1 integrated in the body 11 upon specific technical indications of the manufacturer of silicone valves 5 (FIG. 21).

The lower body 12 is inserted below the valve 5 (preferably with screwing and unscrewing-preventing blocking due to the geometries obtained on the two components, main body 11 and lower body 12 which will be described below in more detail), by stably blocking the valve 5 due to an upper surface 12.7 (FIG. 31) obtained on the lower body 12. Moreover, main body 11 and lower body 12 are stably connected due to the threadings 11.18, 12.12 obtained thereon, as explained below in detail. At the end of their assembly, main body 11 and lower body 12 will mutually push on an upper flange 5.1 (FIG. 21) and a lower flange 5.4 (FIG. 21) of the silicone valve 5, which is preferably made of "soft" silicone, thereby creating the conditions required by the system to obtain the air-tightness, and allowing the liquids to pass only through suitable slits 5.2 obtained on the valve 5, shown in FIG. 21, only when opening the delivering device.

It must be noted that, should the lower body be configured with the integrated counterfeit-preventing flap 4.1 (not shown in the Figures for the version with screwing, but being part of an embodiment of the tap 1 of the invention) before being assembled and afterwards screwed onto the main body 11, it will necessarily have to be closed in its assembling position by inserting the tamper-preventing flap 4.1 inside a suitably studied seat of the lower body, similar to the one shown for the versions of the lower body configured for welding, described below.

Figure 32:
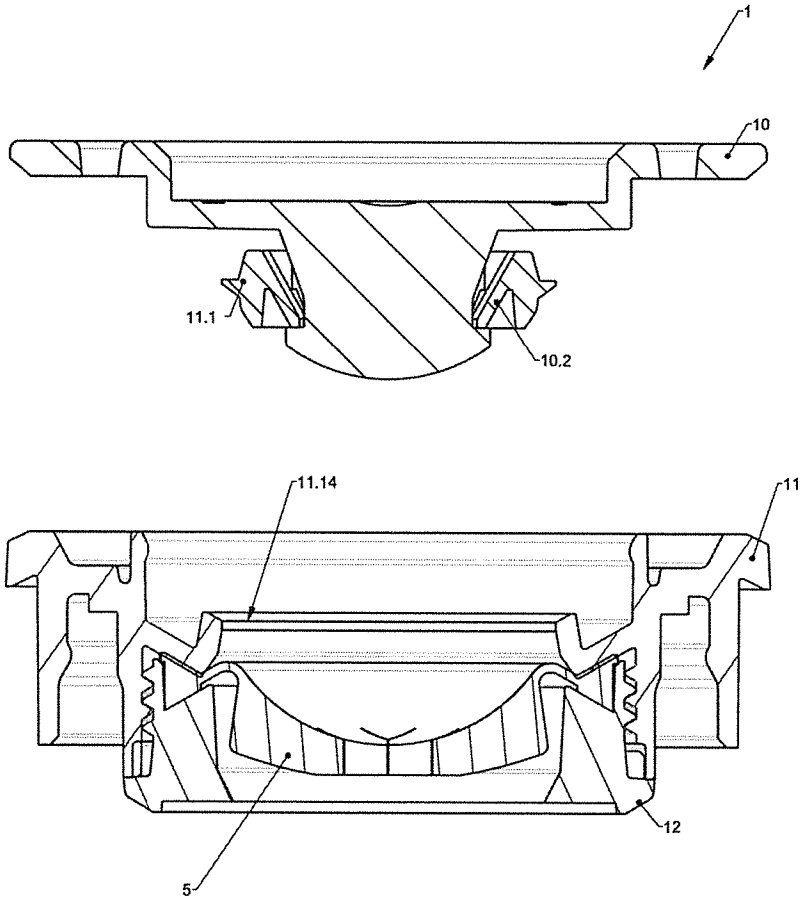
FIG. 32 are two side sectional views of the tap according to the present invention after the removal of the first tamper evident system.
Figure 35:
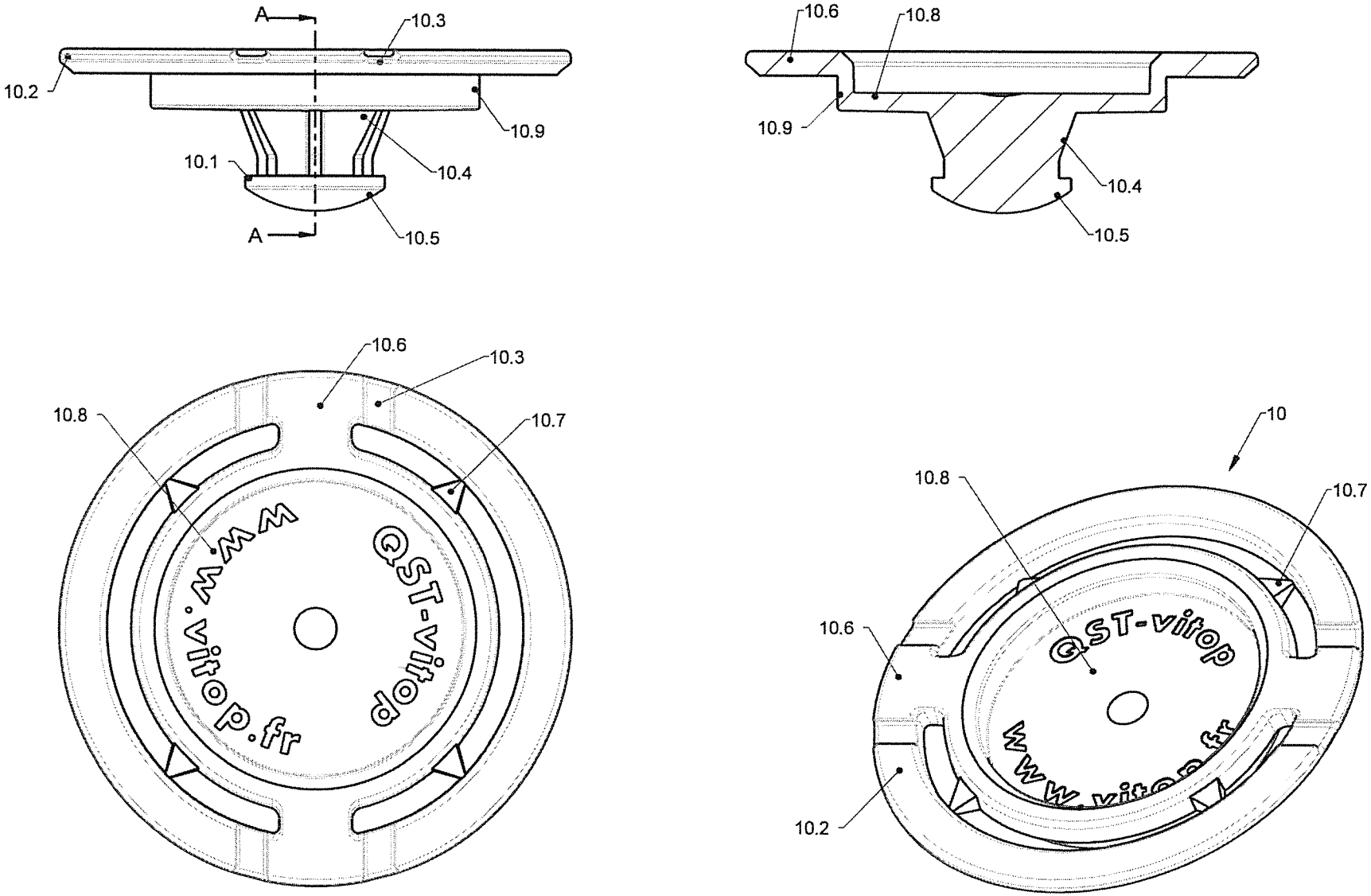
FIG. 35 are side sectional and perspective views of a component of the tap according to the present invention.

Going on analyzing FIG. 27, it can be noted that the upper plug (seal) 10 is stably assembled onto the main body 11 due to its central pin 10.4, shown in FIG. 35, which is inserted and fastened due to the undercut geometry of a small plane 10.1, shown in FIG. 35, in the tamper evident ring 11.1 integrated in the body 11 due to flexible fastening means or wings 11.2 (FIG. 30) present inside the tamper evident ring 11.1; the upper sealing plug 10 and the main body 11, once coupled, become a single component till the first opening of the tap 1, FIG. 32, as shown below.

Figure 28:
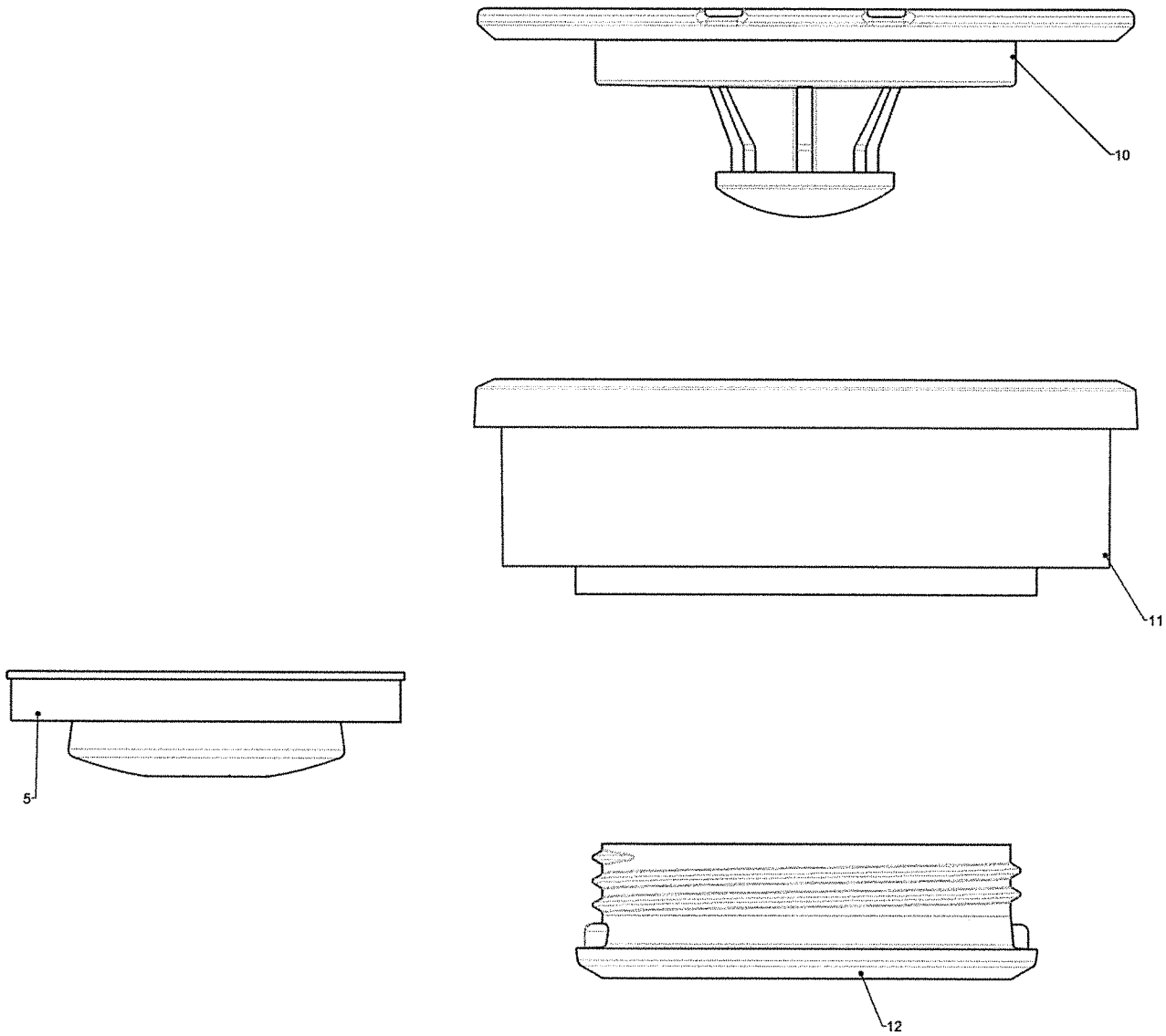
FIG. 28 is an exploded view of the tap of the invention of FIG. 1.
Figure 29:
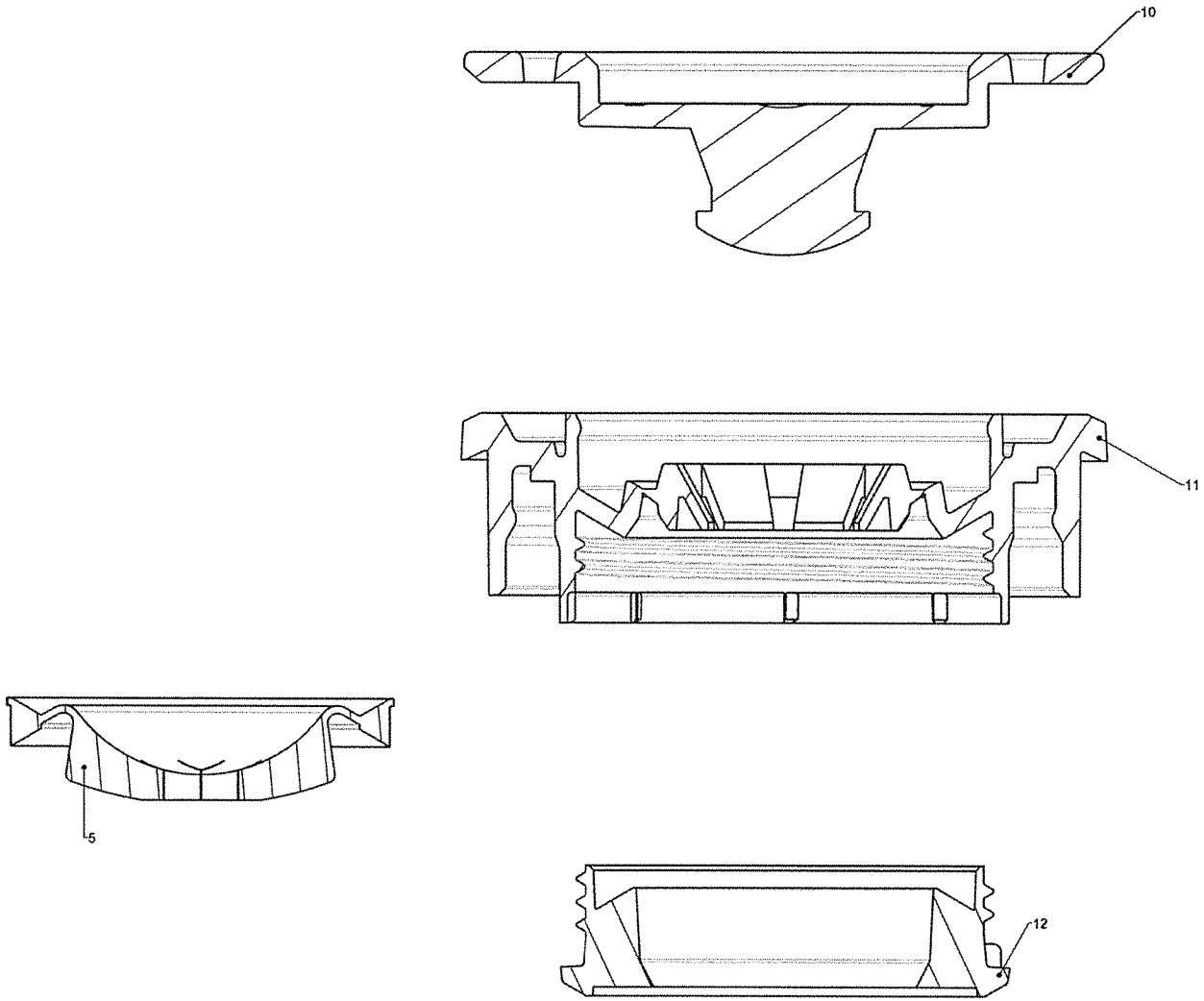
FIG. 29 is an exploded sectional view of the tap of the invention of FIG. 1.

The tap 1 of the invention, as can be seen by FIGS. 28, 29 as regards the configuration with lower body 12 with fastening system of the screwing type (and screwing system with tamper-preventing flap, not shown in the Figures) is formed of four components, three of which are suitably made while the fourth component is the valve, for example made of silicone 5 of a known type, which is purchased from an external manufacturing company, specialized in producing this type of components.

The embodiments of the tap 1 of the invention will now be described, considering the different types of fastening (screwing or welding) between the main body 3, 11 and the lower body 4, 6, 12, comprising the rear counterfeit-preventing flap or without flap.

The purpose is giving the customer a chance of having or not an additional safety system, in addition to the system which is already provided in the basic configuration of the inventive tap 1, due to the upper plug 2, 7, 10 which gets stuck in the ring 3.1, 11.1 of the main body 3, 11, obtaining an efficient front tamper evident counterfeit-preventing system.

The previously described configurations will be better described by some preferred embodiments, provided as a non-limiting example.

The opening step and the connecting step to automatic delivering machines (not shown) of the two embodiments of the invention will be described first.

With reference to FIGS. 27, 28 and 29, the first embodiment of the tap 1 of the invention is described, comprising:

the upper plug or cap 10;

the main body 11;

the valve 5, preferably made of silicone;

the lower body 12 without flap and with tamper-preventing flap (not shown in the figure, but similar to the one described for the version of the lower body 4 fastened through welding of FIG. 19).

With reference to FIG. 27, the inventive tap 1 is shown in its main configuration with the lower body 12 screwed on the main body 11 in its closing/transport position.

The components are mutually stably/operatively connected in the following way to form the inventive tap 1:

on the main body 11, the upper cap 10 will be inserted from the top, and will be fastened to the tamper evident ring 11.1 integrated on the body 11, creating the tamper evident system of the tap, while the upper sealing cylinder of the body 11.8, due to the ring or cylindrical sealing geometry 11.9 (FIG. 30), is coupled, once assembled, with the vertical wall 10.9 (FIG. 35), and creates the right seal to liquids between main body 11 and upper plug 10, further providing the aseptic property, necessary for the tap 1 to enter the market of elements sensible to bacterial contaminations.

The upper cap 10 is stably constrained in engagement due to the flexible wings 11.2 (FIG. 30) present on the tamper evident ring 11.1 of the main body 11, removable when first opening the inventive tap 1, which get stuck with the small plane 10.1 obtained on the central pin 10.4 of the upper plug 10, being stably constrained and becoming a unit therewith.

The upper plug 10 performs a static seal due to an internal sealing cylinder 10.9 present thereon, coupled with the cylindrical sealing geometry 11.9 present on the main body 11. Such coupling allows the tap to have a static seal to liquids and protects the internal silicone valve 5 from dust and from external treatments (for example, sterilization).

The silicone valve 5 (with an upper contact surface 5.1) is placed from the bottom by being inserted into a suitable circular seat 11.3 created in the lower part of the body 11, according to the guidelines imposed by the manufacturers of these silicone valves, which require that, where the seat is placed, their valve must have a particular geometry.

Finally, the lower body 12 is positioned. Such lower body 12 will be coupled with the body 11 and will be fastened thereto, stably constraining it by exploiting the threading 12.12 (FIG. 31) created thereon.

Such process firstly allows a single piece between main body 11 and lower body 12 (this is also true for the lower body version with flap, not shown) and further allows providing the right sealing pre-load to the silicone valve 5, which, in this way, performs its seal to liquids on the main body 11.

The lower body 12 comprises the upper surface 12.7, where the silicone valve 5 is placed (with a lower contact surface 5.4), which operates as lower seat of the silicone valve 5, and always follows the geometric guidelines imposed by manufacturers of silicone valves.

With reference to FIG. 32, it is possible to note the first opening step of the delivering tap 1, which consists in the removal of the upper plug 10, which is constrained to the main body 11 by means of the tamper evident ring 11.1 of the body 11 and the small plane 10.1 of the upper plug 10, freeing the passage 11.14, which then allows the connectors 8 (FIG. 24) and 9 (FIG. 23) to reach and be stably connected to the silicone valves 5, present and constrained on the body 3 by means of the lower body 4, allowing to deliver/open the valve 5 and the tamper-preventing flap.

The tamper evident ring 11.1 of the main body 11 remains attached to the upper plug 10 due to the flexible winds 11.2 and the small plane 10.1 obtained on the upper plug 10, and provides evidence of opening for the end customer, protecting him from the danger of opening and filling the container (preferably BIB) with counterfeit liquids.

Once having removed the tap 10, it is impossible to correctly re-position the ring 11.1, providing an optimum guarantee to the end customer.

Figure 33:
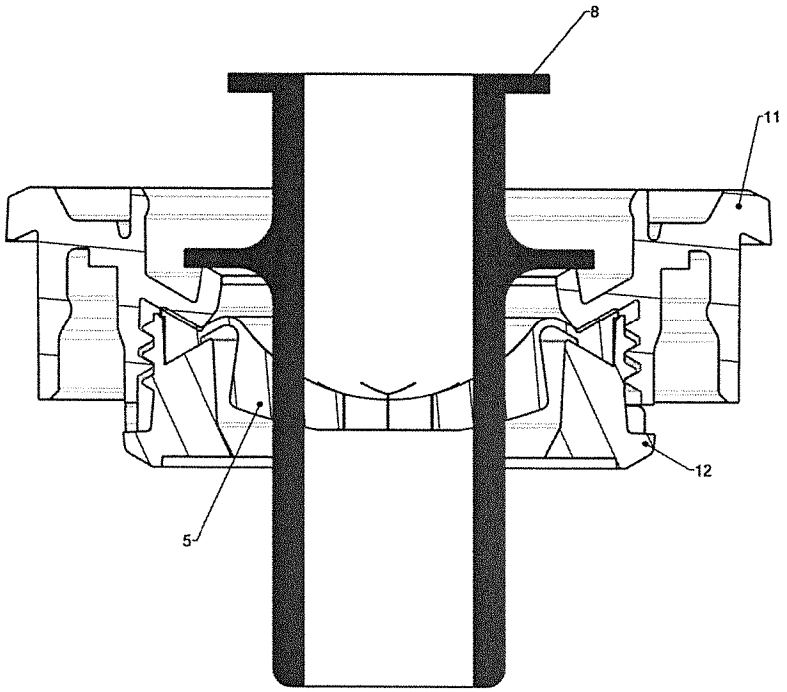
FIG. 33 are two side sectional views of the tap according to the present invention in its complete opening position after having inserted a pin.
Figure 34:
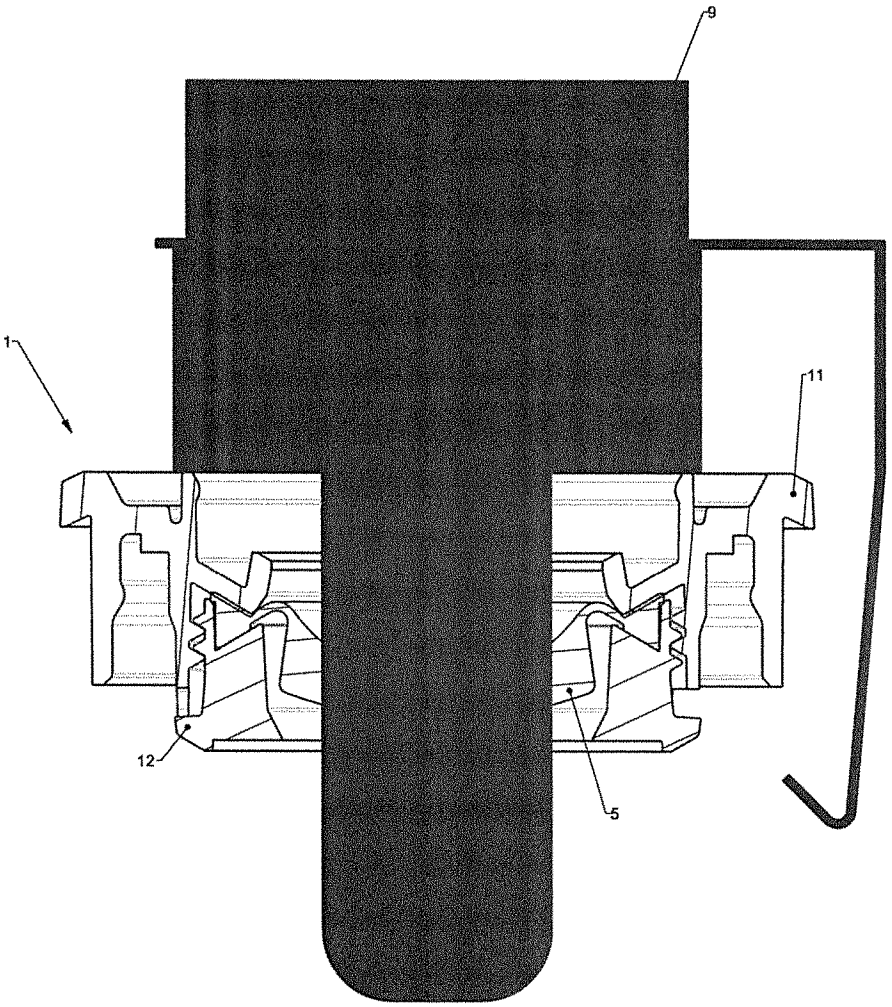
FIG. 34 are two side sectional views of the tap according to the present invention in its completely open position after having inserted a pin.

With reference to FIGS. 33 and 34, it is possible to note the insertion and activation/opening for delivering of the inventive tap 1.

Figure 7:
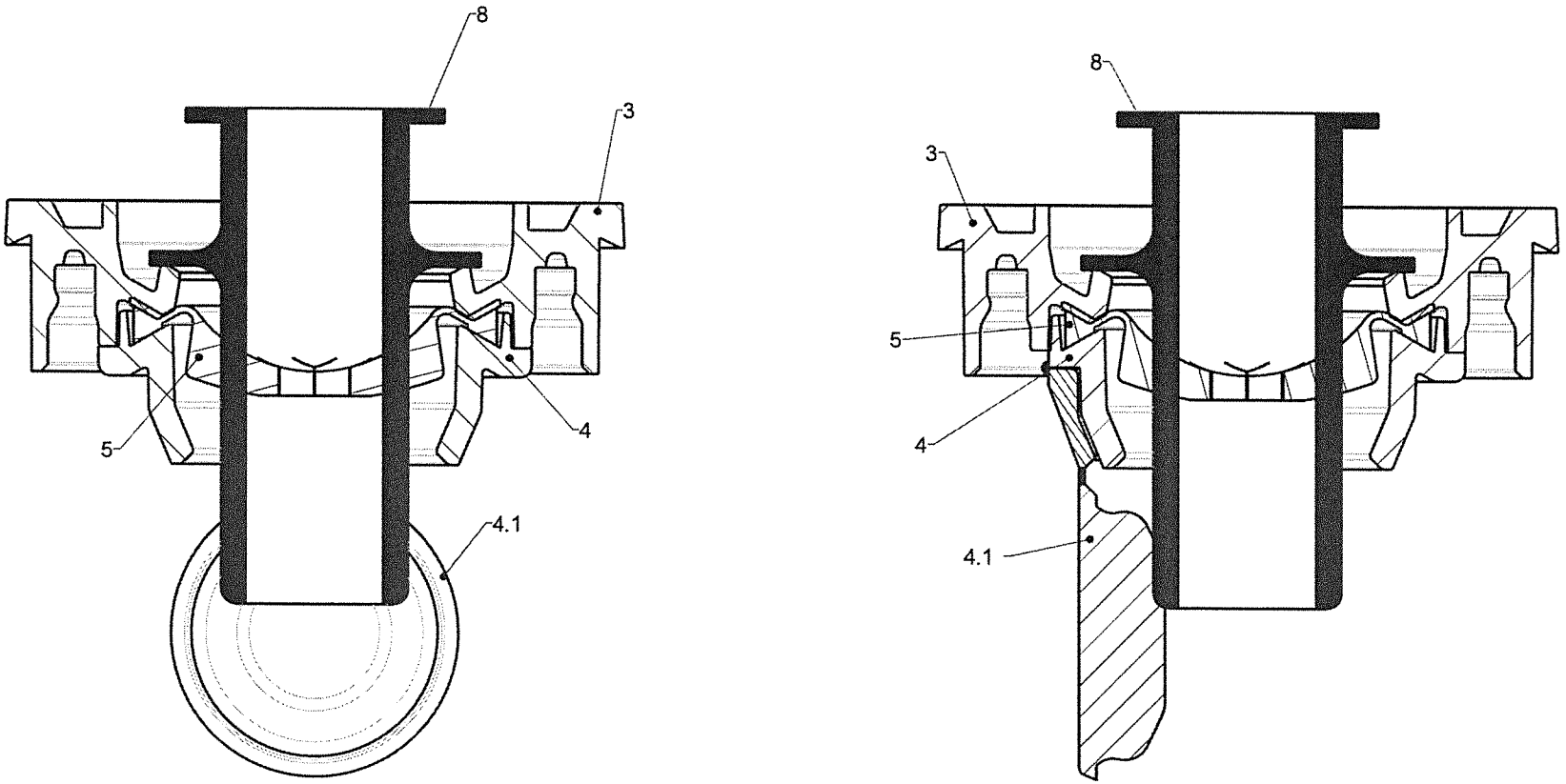
FIG. 7 are two side sectional views of the inventive tap in its completely open position after inserting the pin.

Precisely, FIG. 7 shows the insertion of the connector 8 of the Taylor machine.

Figure 24:
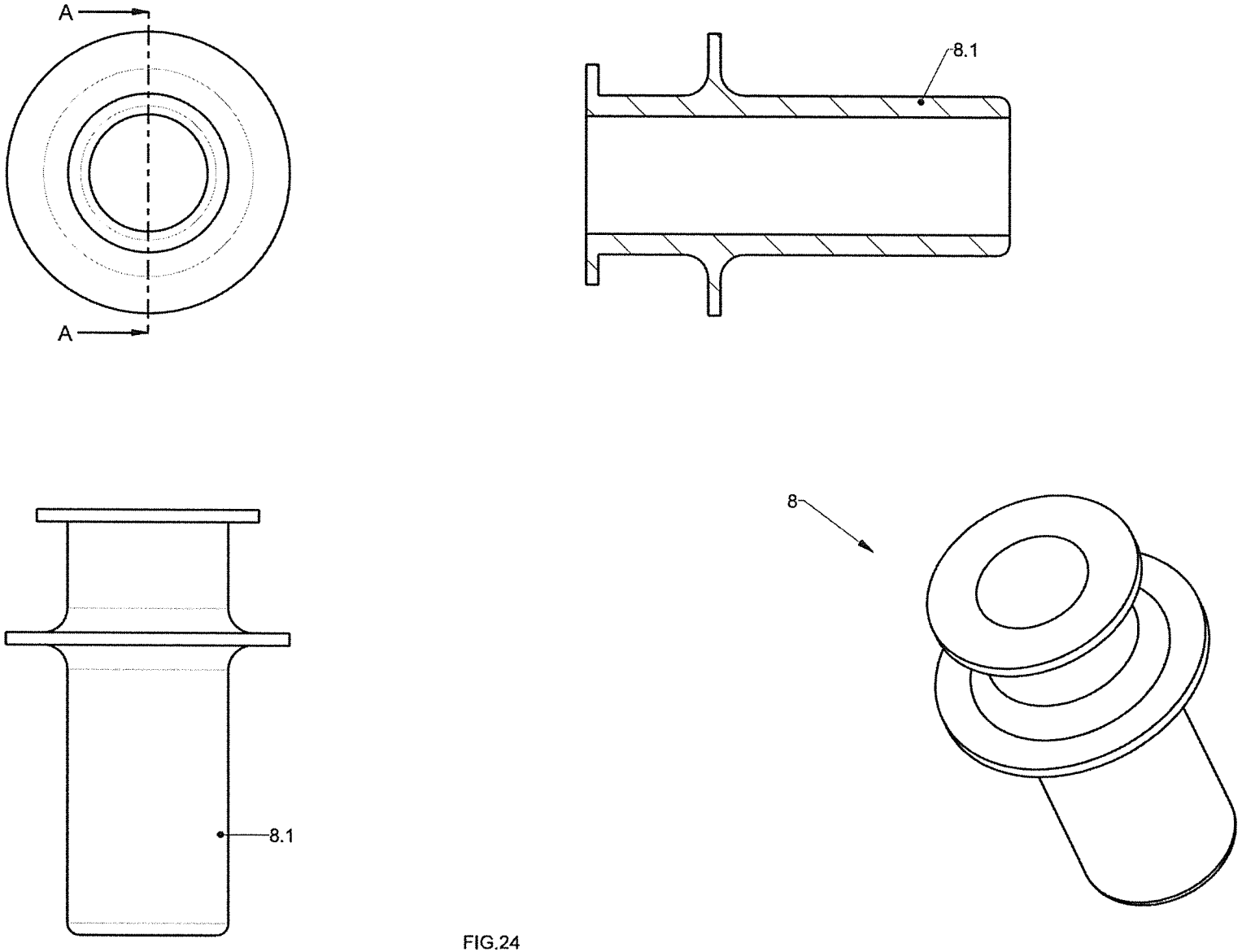
FIG. 24 is a series of views and sections of the Taylor model connector.
Figure 25:
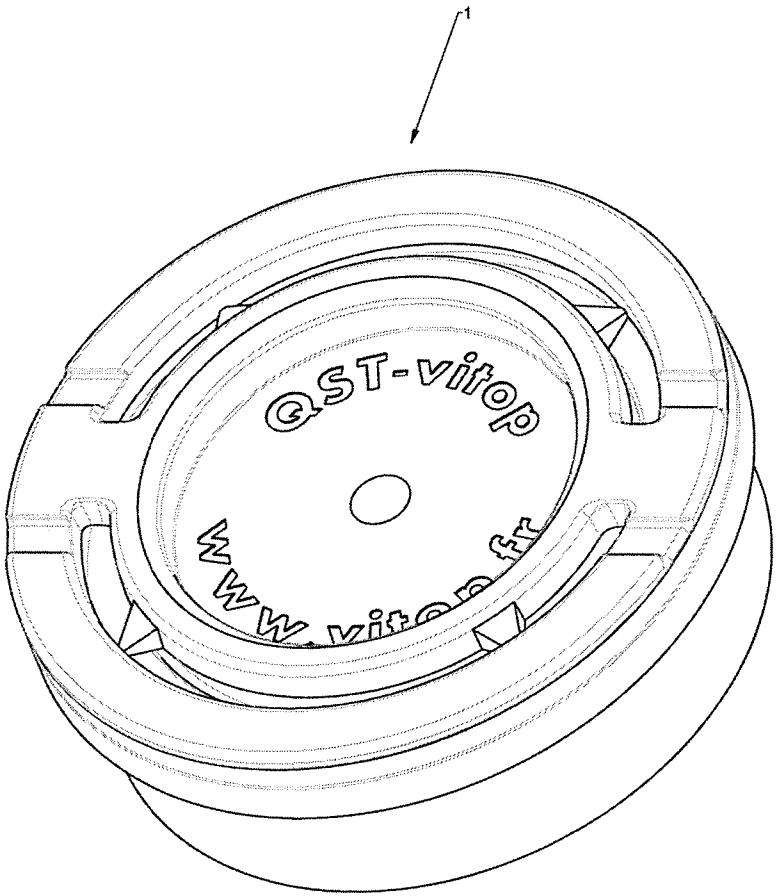
FIG. 25 is a perspective view of an embodiment of the tap according to the present invention.
Figure 26:
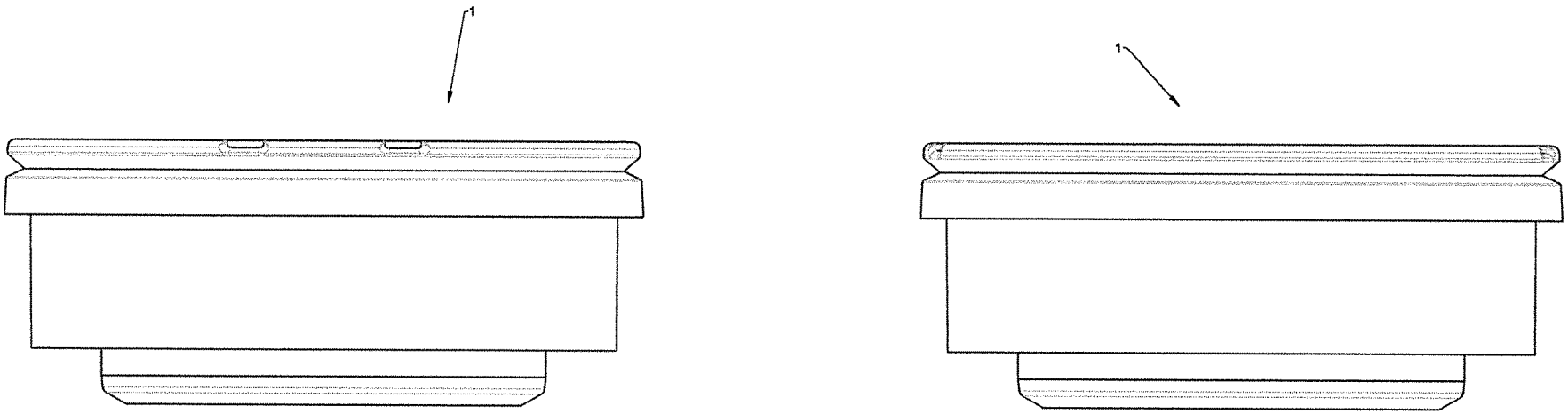
FIG. 26 are two side views of the tap according to the present invention.

In this case, the connecting pin 8, Taylor model, penetrates into the silicone valve 5 centrally, dilating the slits 5.2 (FIG. 33) present on the valve itself and performing a seal on the external diameter 8.1 of the pin 8 (FIG. 24). The pin 8, during the first opening step, pushes when penetrating the silicone valve 5 thereby opening the system. In the version with lower body fastened through screwing (not shown, but being part of an embodiment of the tap 1 of the invention), the pin 8 pushes the tap comprising the flap, opening it during its first penetration (not shown in the Figures). Such operation guarantees, till the first opening, to have a second counterfeit-preventing seal present on the inventive tap 1, providing a second and additional guarantee for the customer.

Moreover, it guarantees a stronger liquid seal and a higher oxygen barrier before the first opening.

It will obviously be possible to remove the pin 8, Taylor model, from the tap 1 of the invention also when the container is not yet empty, by exploiting the self-sealing feature of the silicone valve 5.

Figure 23:
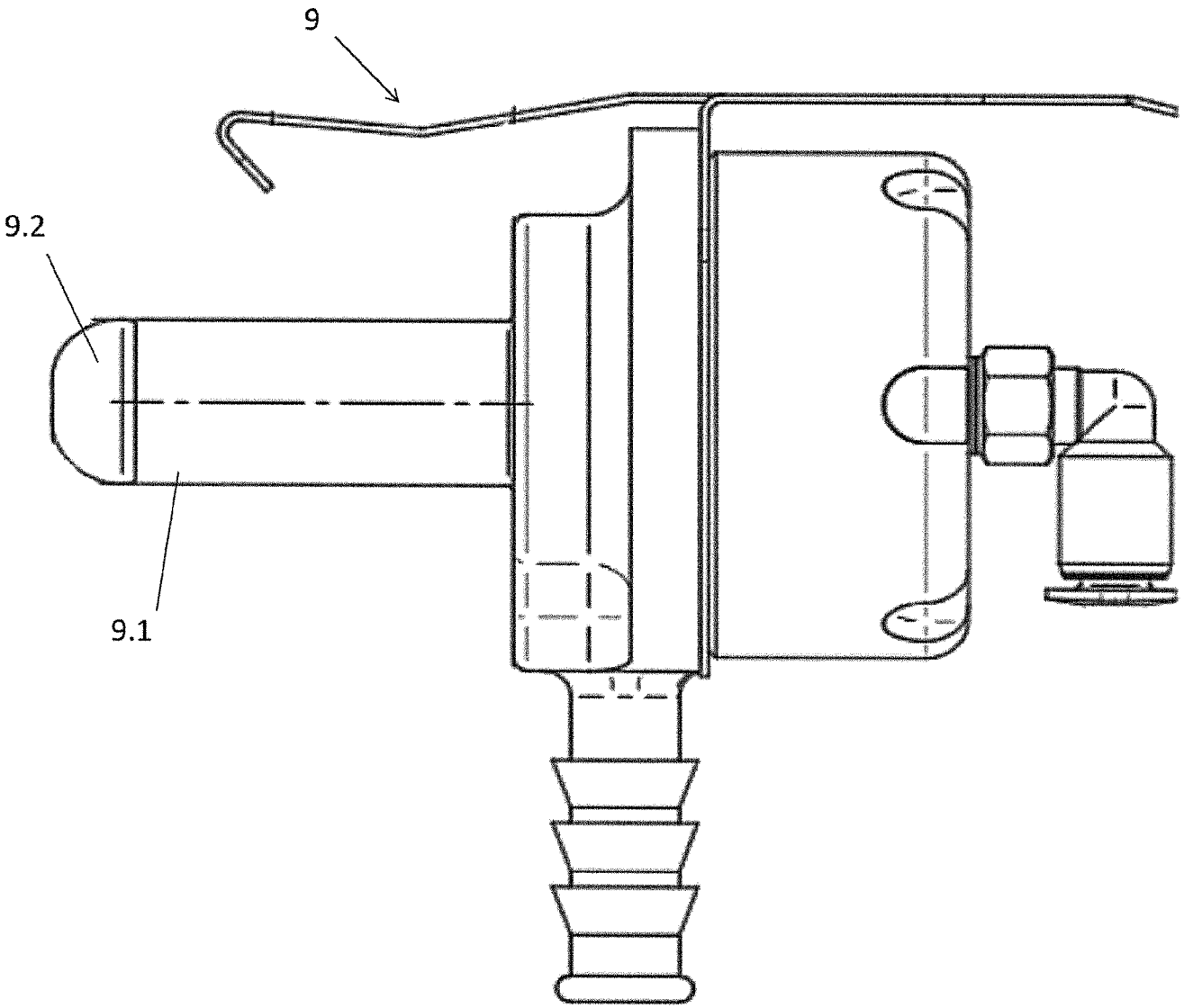
FIG. 23 is a series of views and sections of the Carpigiani model connector.

Analyzing FIG. 34, the insertion of the connector 9 for the Carpigiani machine is described (FIG. 23).

In this case, the connection pin 9, Carpigiani model, penetrates into the silicone valve centrally, dilating the through pre-cut 5.2 (FIG. 21) present on the valve itself and performing a seal on the external diameter 9.1 of the pin 9 (FIG. 24). The pin 9, during the first opening step, pushes, when penetrating, the silicone valve 5 and in case of lower body with tamper-preventing flap (not shown for this version) in turn pushes the flap of the lower body opening the system. Such operation guarantees, till the first opening, to have a second counterfeit-preventing seal present on the inventive tap 1, providing a second and additional guarantee to the client. Moreover, it guarantees a stronger seal to liquids and a higher oxygen barrier before the first opening.

It will obviously be possible to remove the pin 9, Carpigiani model, from the inventive tap 1 also when the container is not yet empty, by exploiting the self-sealing feature of the silicone valve.

Figure 1:
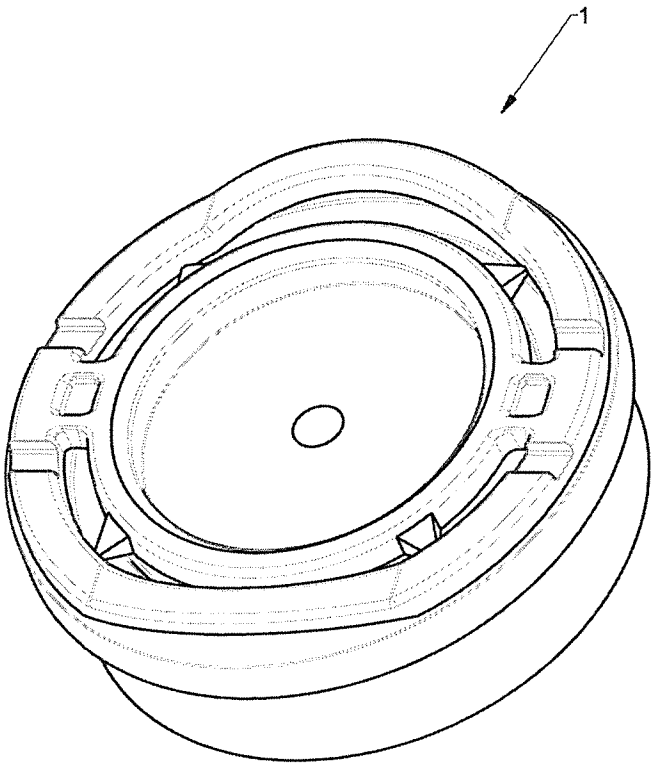
FIG. 1 is a perspective view of an embodiment of the tap according to the present invention.
Figure 2:
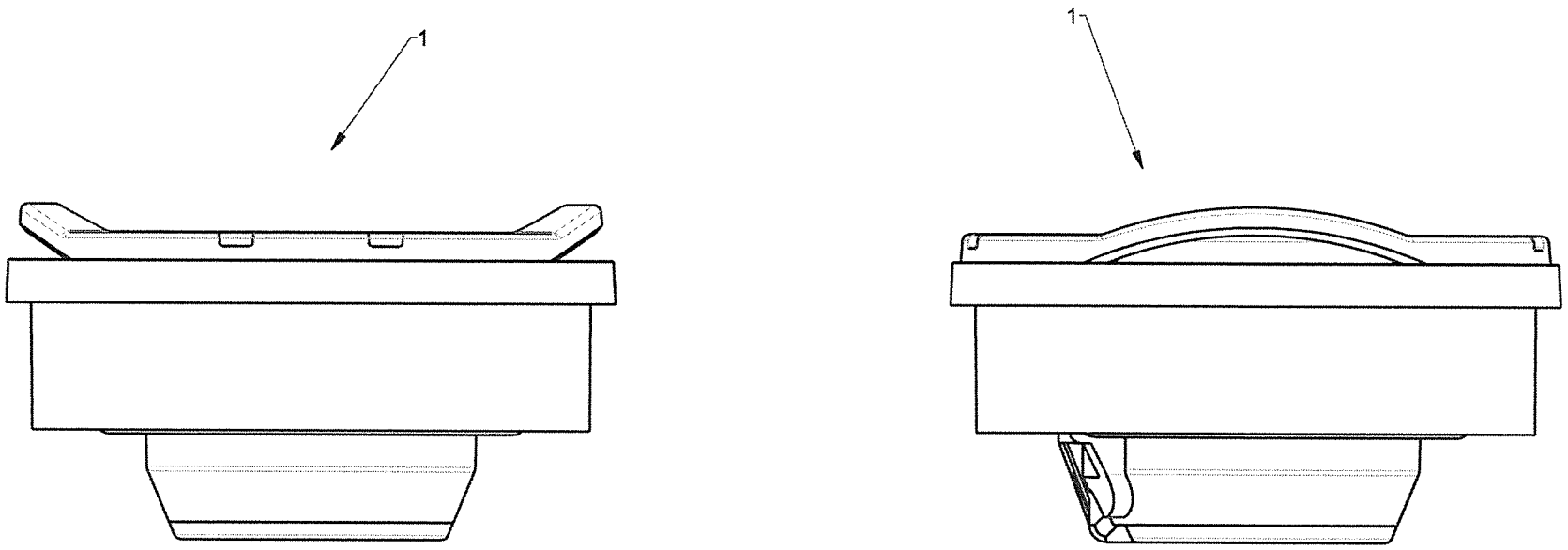
FIG. 2 are two side views of the tap according to the present invention.
Figure 3:
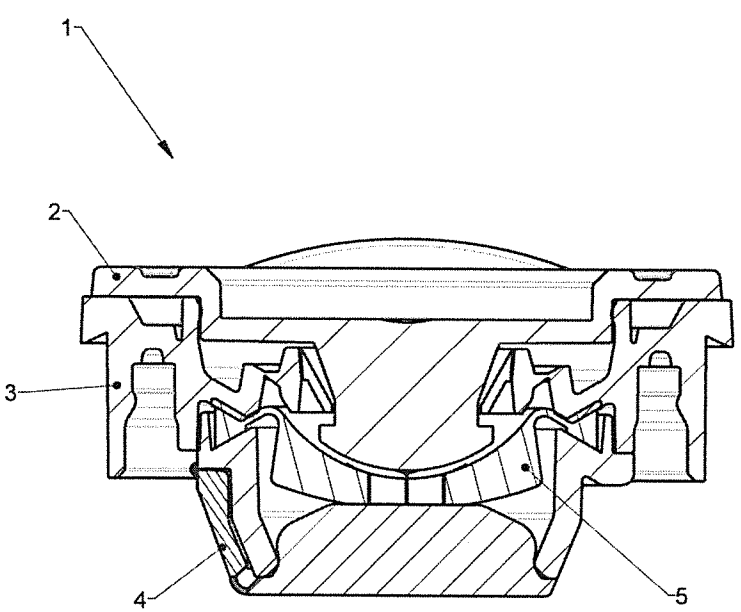
FIG. 3 are two side sectional views of the assembled tap of FIG. 1 in its completely closed position.
Figure 3:
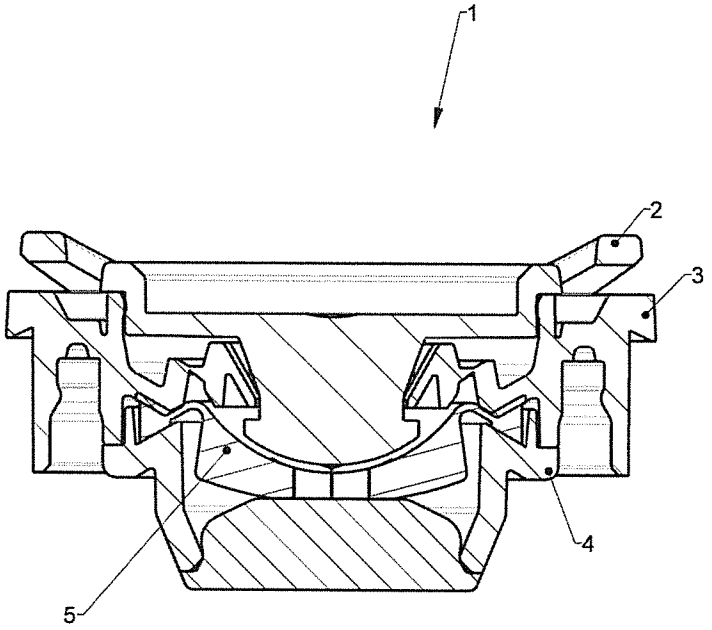

Taking into account the embodiment of the tap 1 of the invention, in which the two components, main body 3 and lower fastening body 4, 6, are connected through welding (for example with hot blade, ultrasound or laser) as shown in FIGS. 1 to 8, with reference to FIG. 3, the section is shown at 0° and 90° of the inventive tap 1 assembled and in its closure and transport position.

In particular, with reference to FIG. 3, it can be noted that the silicone valve 5 is inserted into a circular seat 3.3 (FIG. 17), obtained in the lower part of the tamper evident ring 3.1 integrated in the body 3.

The lower body 4 (or 6, if this is the version without tamper-preventing flap 4.1) is inserted below the valve 5 (preferably through ultrasound or laser welding to the main body 3), stably blocking the valve 5 due to an upper surface 4.7 (FIG. 19) obtained on the lower body 4 (or 6, if this is the other version 6.7, FIG. 20). Moreover, the body 3 and the lower body 4 (or 6) become a single piece after welding, and the valve 5, for example made of "soft" silicone, which is placed between the two components, body 3 and lower body 4 (or 6), ensures the air-tightness, allowing the liquids to pass only through suitable slits 5.2 obtained on the valve 5, shown in FIG. 21, only when opening the delivering device.

It must be noted that the lower body 4, before being assembled and afterwards welded to the body 3, must be closed in its assembling position by inserting a tamper-preventing flap 4.1 inside a seat of the lower body 4. In order to better understand, the tamper-preventing flap 4.1 is bent by following specific guiding geometries 4.12 and 4.14, which connect it to the lower body 4 (FIG. 19).

Going on describing FIG. 3, it can be noted that the upper sealing cap 2 is stably assembled to the main body 3 due to its central pin 7.4 (FIG. 22), which will be inserted and fastened, due to an undercut geometry 7.1 (FIG. 22), in the tamper evident ring 3.1 integrated in the body 3, thanks to flexible fastening means or wings 3.2 (FIG. 17) present inside the tamper evident ring 3.1; the upper sealing cap 2 and the main body 3, once coupled, become a single component, until the first opening of the tap occurs, as described below.

Figure 4:
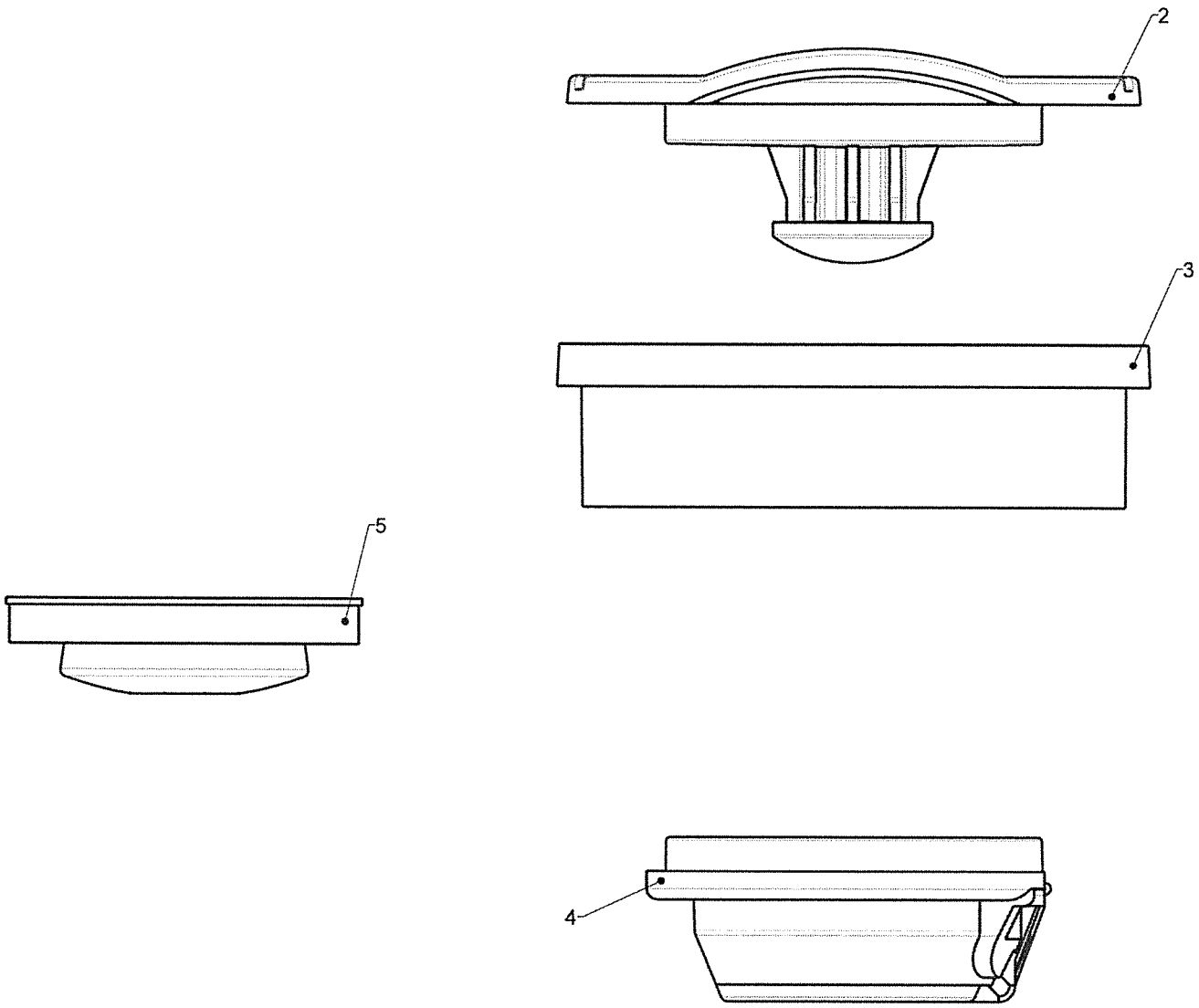
FIG. 4 is an exploded view of the inventive tap of FIG. 1.
Figure 5:
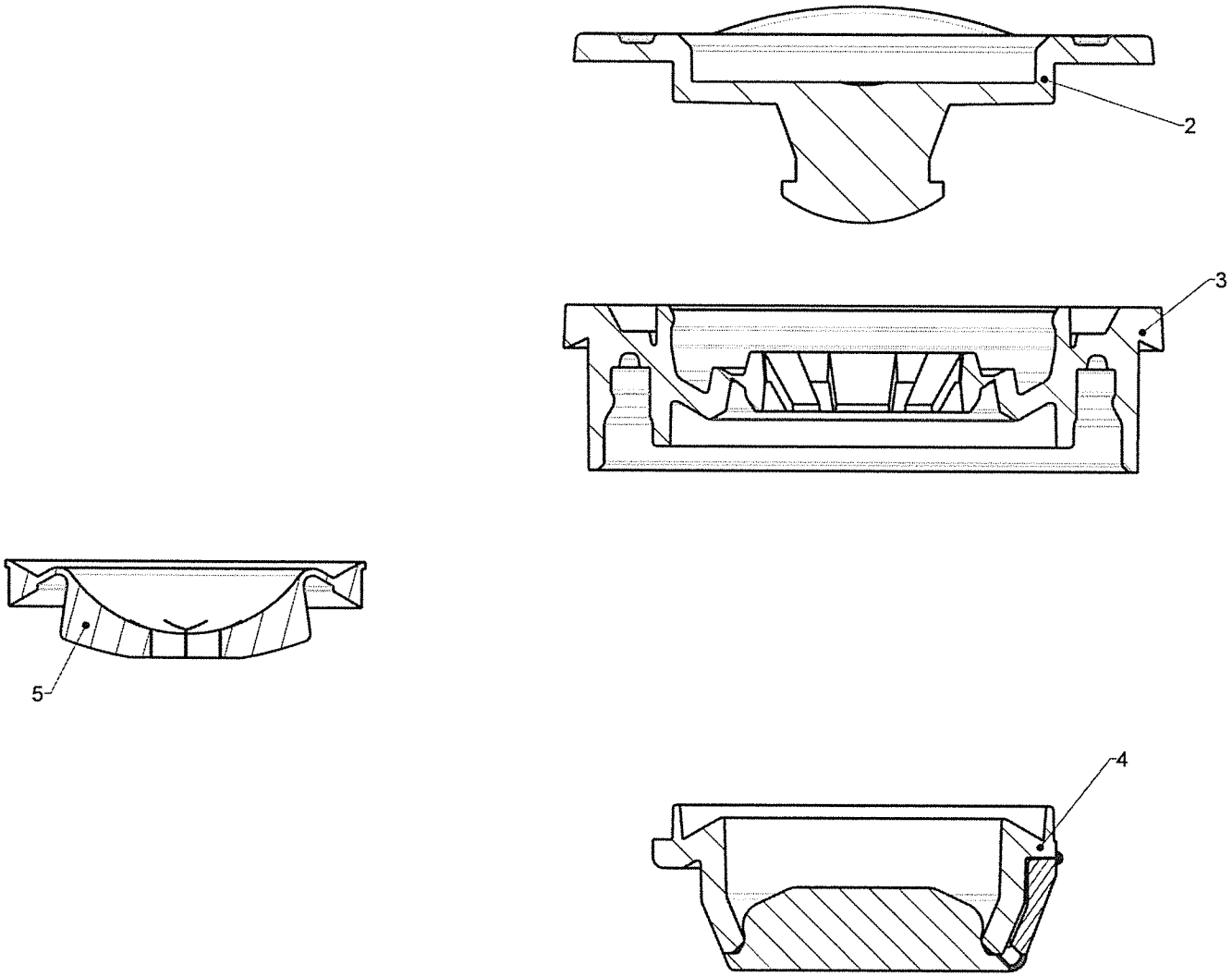
FIG. 5 is an exploded sectional view of the inventive tap of FIG. 1.
Figure 12:
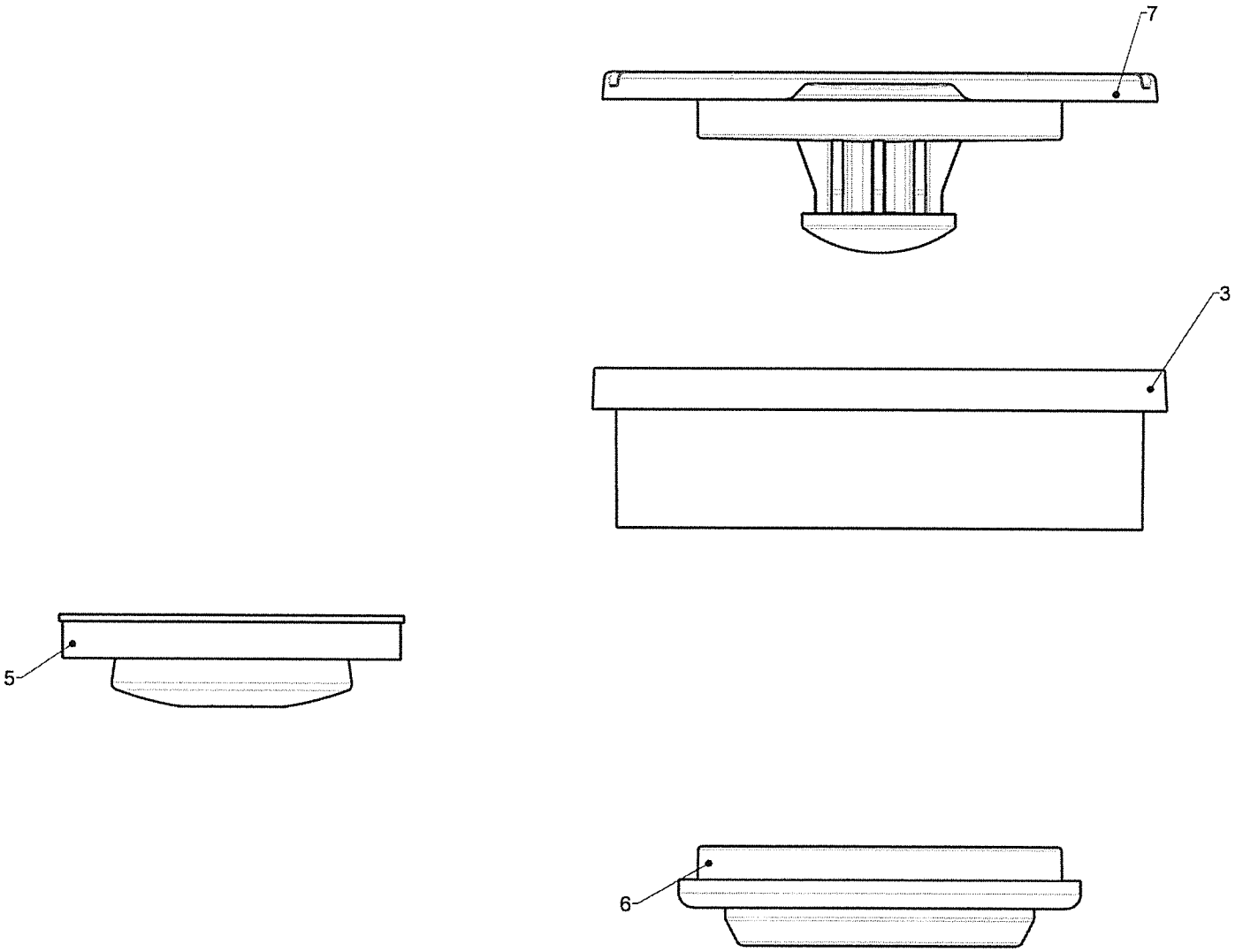
FIG. 12 is an exploded view of the inventive tap of FIG. 1.
Figure 13:
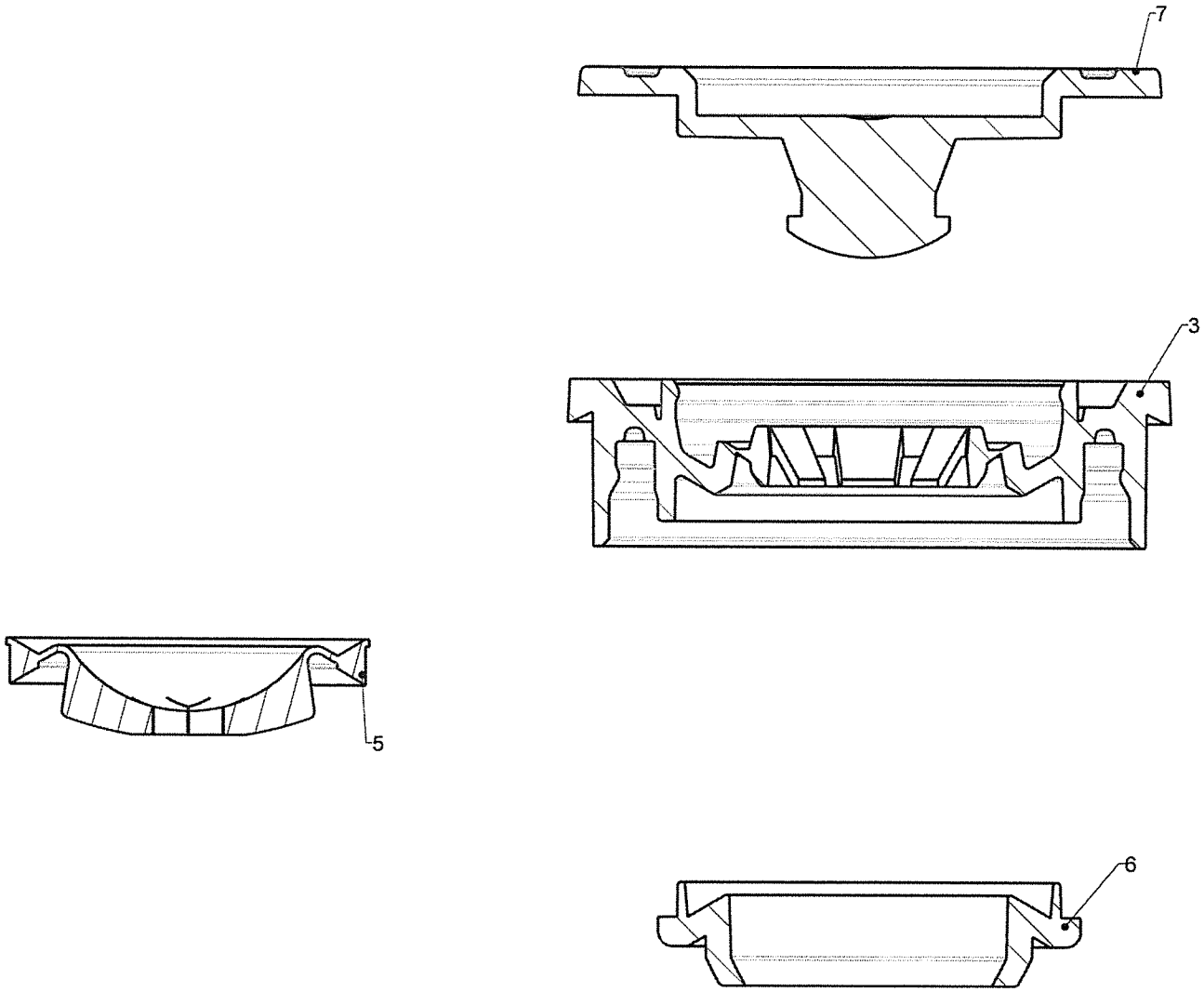
FIG. 13 is an exploded sectional view of the inventive tap of FIG. 1.

The tap 1 of the invention, as can be seen from FIGS. 4, 5 as regards the configuration with lower body equipped with system with integrated tamper-preventing flap 4.1 (while FIGS. 12, 13 show the simplified configuration without the additional system with tamper-preventing flap), is formed of four components, three of which are manufactured by company Vitop, while the fourth component is the silicone valve 5, which is purchased from an external manufacturing company specialized in producing this type of components.

The two embodiments of the inventive tap 1 with and without system with rear counterfeit-preventing flap will now be described.

The purpose is providing the customer with the chance of having or not an additional safety system, taking into account that, already in its basic configuration, the inventive tap 1 is equipped, due to the upper plug 2 which gets stuck into the ring 3.1 of the main body 3, with an efficient front tamper evident, counterfeit-preventing system.

The previously described configurations will be better described by some preferred embodiments thereof, provided as a non-limiting example.

The opening step and the connecting step of automatic delivering machines (not shown) will first be described for the two version disclosed in the present Application.

With reference to FIGS. 4 and 5, the first embodiment of the tap 1 of the invention is shown, comprising:

the upper plug or cap 2;

the main body 3;

the valve 5, preferably made of silicone;

the lower body 4 with tamper-preventing flap 4.1 closed in its use position.

With reference to FIG. 3, the inventive tap 1 is shown in its configuration with sealing system 4.1 with rear counterfeit-preventing flap closed, in its closure/transport position.

The pieces are mutually stably/operatively connected in the following way, to form the inventive tap 1.

The upper plug 2 is inserted from the top on the main body 3.

The upper plug 2 is stably constrained in engagement due to the flexible wings 3.2 of the main body 3 (FIG. 17), present on the tamper evident ring 3.1, removable when first opening the inventive tap 1, which get stuck with a small plane 2.1 obtained on the central pin 2.4 of the upper plug 2 by being stably constrained and becoming a single unit therewith.

The upper plug 2 performs a static seal due to an internal sealing cylinder 2.9 present thereon, coupled with a cylindrical sealing geometry 3.9 present on the main body 3. Such coupling allows the tap to have a static seal to liquids and protects the internal silicone valve from dust and external treatments (for example, sterilization).

The silicone valve 5 (with a contact surface 5.1 is placed from below, by being inserted into a suitable circular seat 3.3 created in the lower part of the body 3 according to the guidelines imposed by the manufacturers of these silicone valves, which require that the seat, where their valve is places, must have a particular geometry.

Finally, the lower body 4 is positioned, which have been previously taken from its molding position shown in FIG. 19 to its assembling position, by closing the anti-counterfeiting flap 4.1.

Such lower body 4 will be coupled with the body 3 and will be fastened thereto, stably constraining by exploiting one of the known welding technologies (ultrasound or laser or hot blade) present on the market.

Such process allows firstly obtaining a single piece between main body 3 and lower body 4 with flap, and moreover allows providing the right sealing pre-load to the silicone valve 5, which in this way performs its seal to liquids on the main body 3.

The lower body 4 comprises the upper surface 4.7, where the silicone valve 5 is placed (with a contact surface 5.4), which operates as lower seat of the silicone valve 5, and always follows the geometric guidelines required by the manufacturers of silicone valves.

Figure 6:
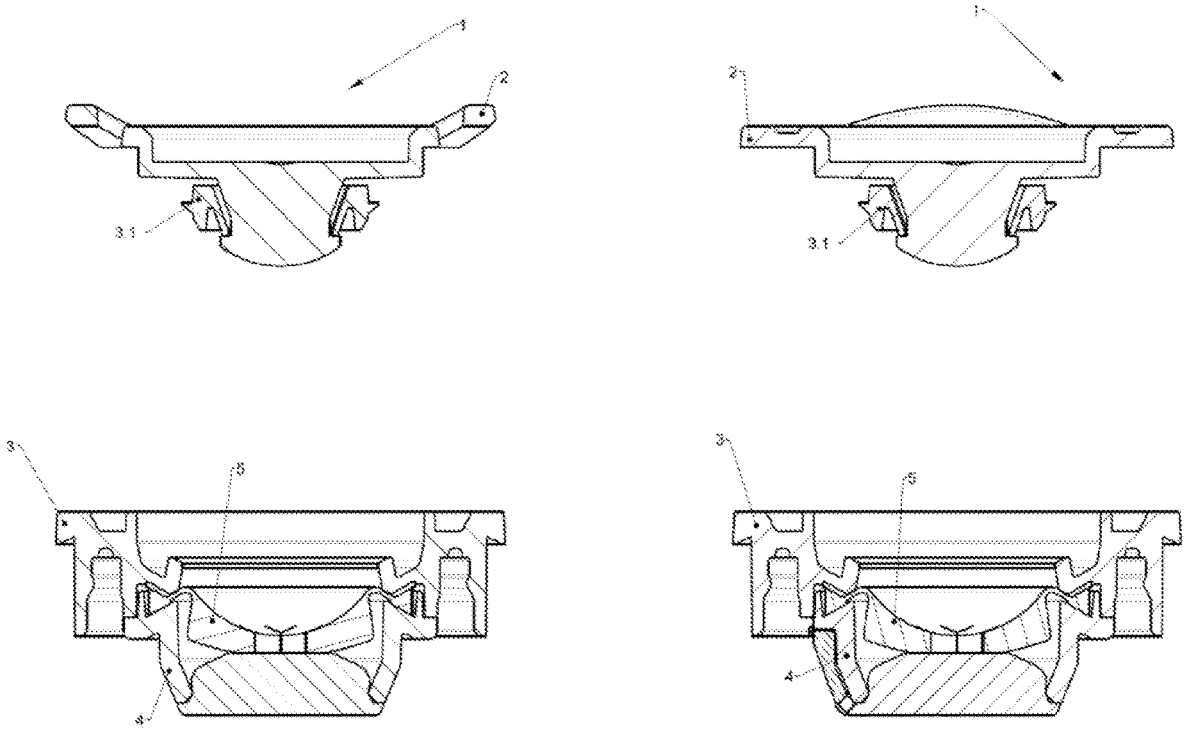
FIG. 6 are two side sectional views of the inventive tap after the removal of the first tamper evident system.

With reference to FIG. 6, it is possible to note the first opening step of the delivering tap 1, which consists in the removal of the upper plug 2, which is constrained to the main body 3 by means of the tamper evident ring 3.1 of the body 3 and the small plane 2.1 of the inventive tap 1, freeing the passage 3.14 to allow the connectors 8 and 9 to reach and be stably connected to the silicone valves 5 present and constrained to the body 3 by means of the lower body 4, allowing to deliver/open the valve 5 and the tamper-preventing flap 4.1 as will be described below.

The tamper evident ring 3.1 of the main body 3 remains attached to the upper plug 2 due to the flexible wings 3.2 and the small plane 2.1 obtained on the upper plug 2, and provides evidence of opening to the end customer, protecting him from the danger of opening and filling the container (preferably BIB) with counterfeited liquids.

Once removed the tap, it will be impossible to correctly re-position the ring 3.1, providing an optimum guarantee to the end consumer.

Figure 8:
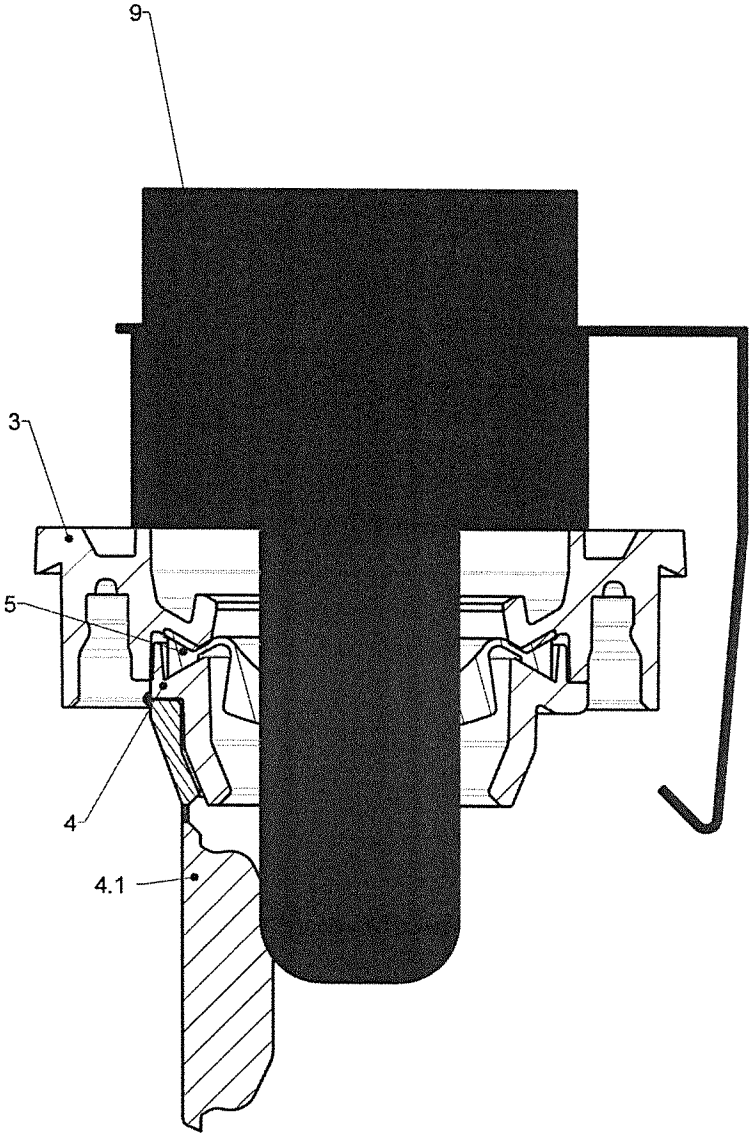
FIG. 8 are two side sectional views of the inventive tap in its completely open position after inserting the pin.
Figure 8:
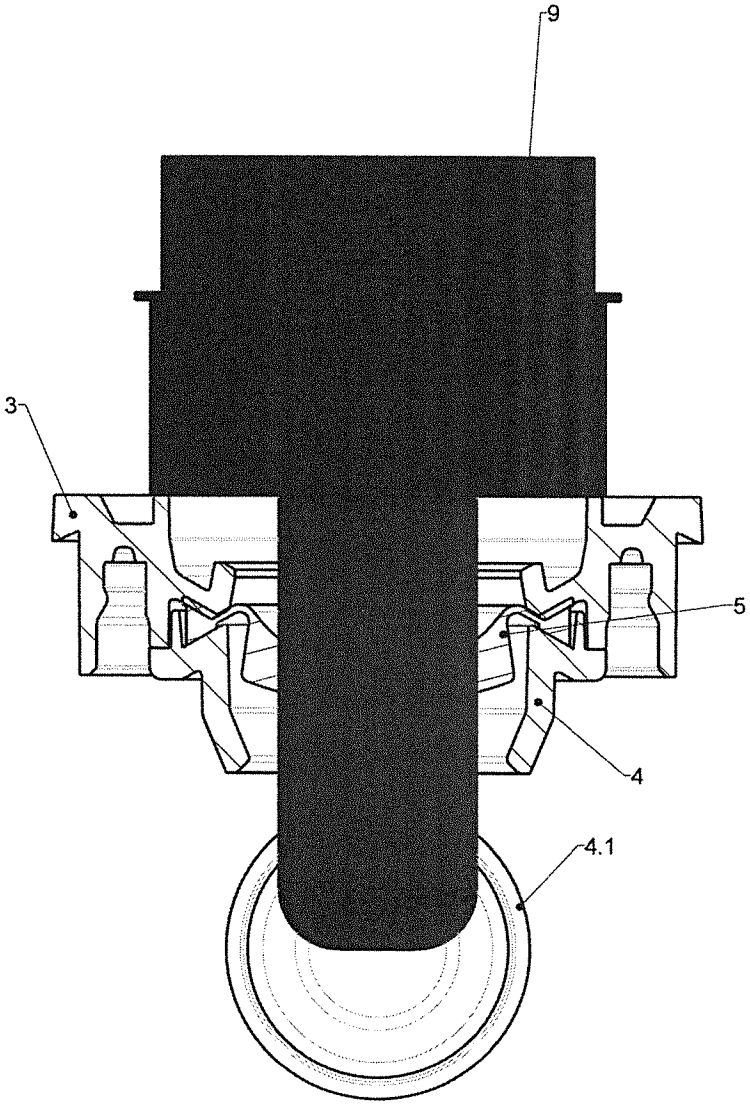
Figure 9:
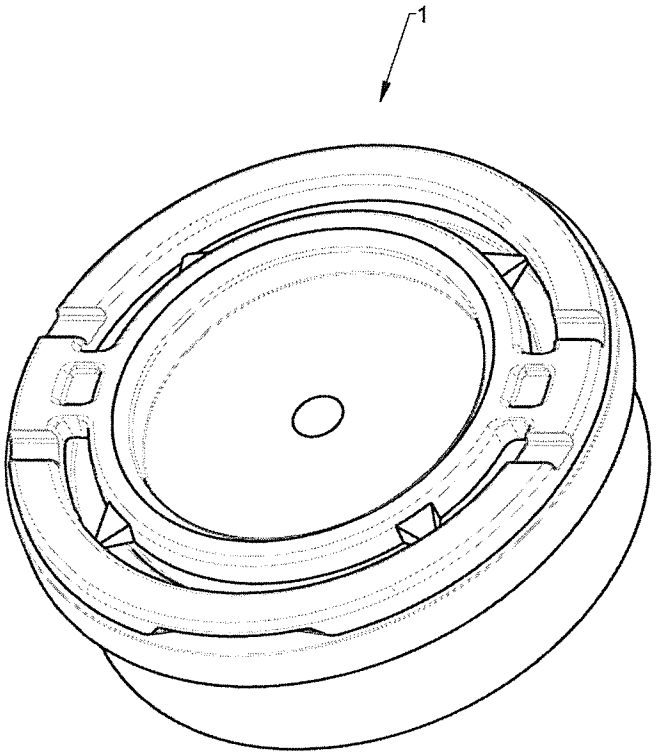
FIG. 9 is a perspective view of an embodiment of the tap according to the present invention.
Figure 10:
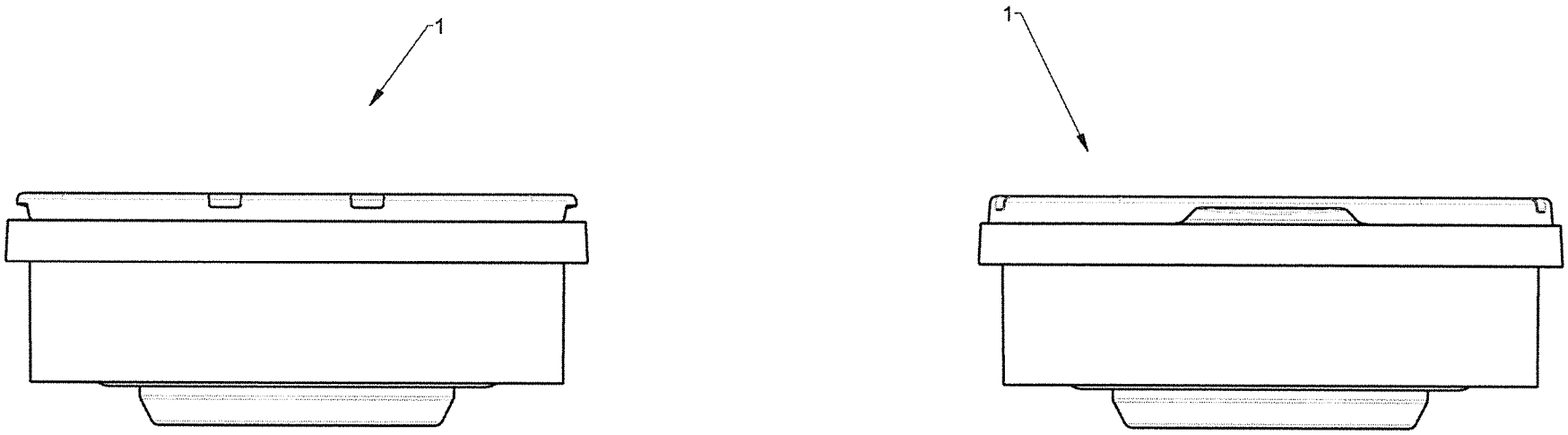
FIG. 10 are two side views of the tap according to the present invention.
Figure 11:
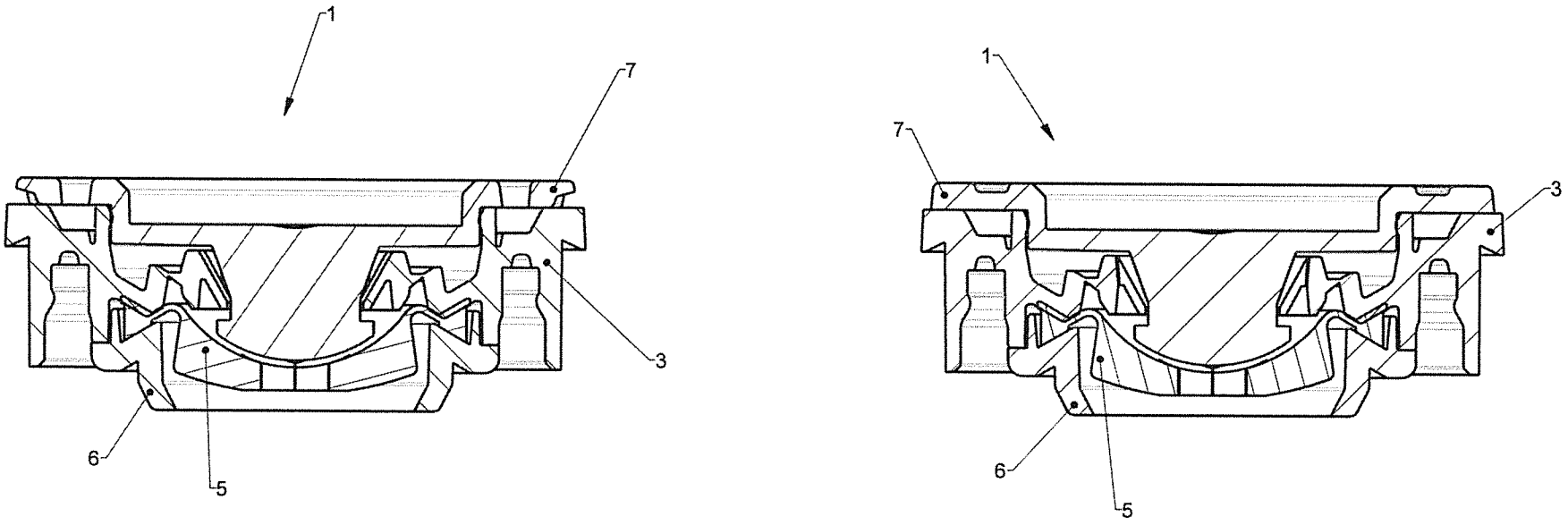
FIG. 11 are two side sectional views of the assembled tap of FIG. 1 in its completely closed position.

With reference to FIGS. 7 and 8, it is possible to see insertion and activation/opening for delivering of the inventive tap 1.

Precisely, FIG. 7 shows the insertion of the connector 8 of the Taylor machine (FIG. 24).

In this case, the connection pin 8, Taylor model, penetrates into the silicone valve centrally, dilating the through pre-cut 5.2 (FIG. 21) present on the valve itself and performing a seal on the external diameter 8.1 of the pin 8 (FIG. 24). The pin 8, during the first opening step, pushes, when penetrating, the silicone valve 5 which in turn pushes the flap 4.1 of the lower body 4, opening the system.

Such operation guarantees, till the first opening, to have a second counterfeit-preventing seal present on the inventive tap 1, giving a second and additional guarantee to the customer. Moreover, it guarantees a greater seal to liquids and a higher oxygen barrier before the first opening.

It will obviously be possible to remove the pin 8, Taylor model, from the inventive tap also when the container is not yet empty, by exploiting the self-sealing feature of the silicone valve 5.

Taking into account FIG. 8, the insertion of the connector 9 of the Carpigiani machine (FIG. 23) will be described.

In this case, the connection pin 9, Carpigiani model, penetrates into the silicone valve centrally, dilating the through pre-cut 5.2 (FIG. 21) present on the valve itself, and performing a seal on the external diameter 9.1 of the pin 9 (FIG. 24). The pin 9, during the first opening step, pushes, when penetrating, the silicone valve 5, which in turn pushes the flap 4.1 of the lower body 4, opening the system.

Such operation guarantees, till the first opening, to have a second counterfeit-preventing seal present on the inventive tap 1, giving a second and additional guarantee to the customer. Moreover, it guarantees a stronger seal to liquids and a higher oxygen barrier before the first opening.

It will obviously be possible to remove the pin 9, Carpigiani model from the inventive tap also when the container is not yet empty, by exploiting the self-sealing feature of the silicone valve 5.

With reference to FIGS. 12 and 13, it is possible to note a second embodiment of the tap 1 of the invention formed of:

an upper plug or cap 7;

the main body 3;

the valve 5, preferably made of silicone;

a lower body 6 without tamper-preventing flap.

Figure 14:
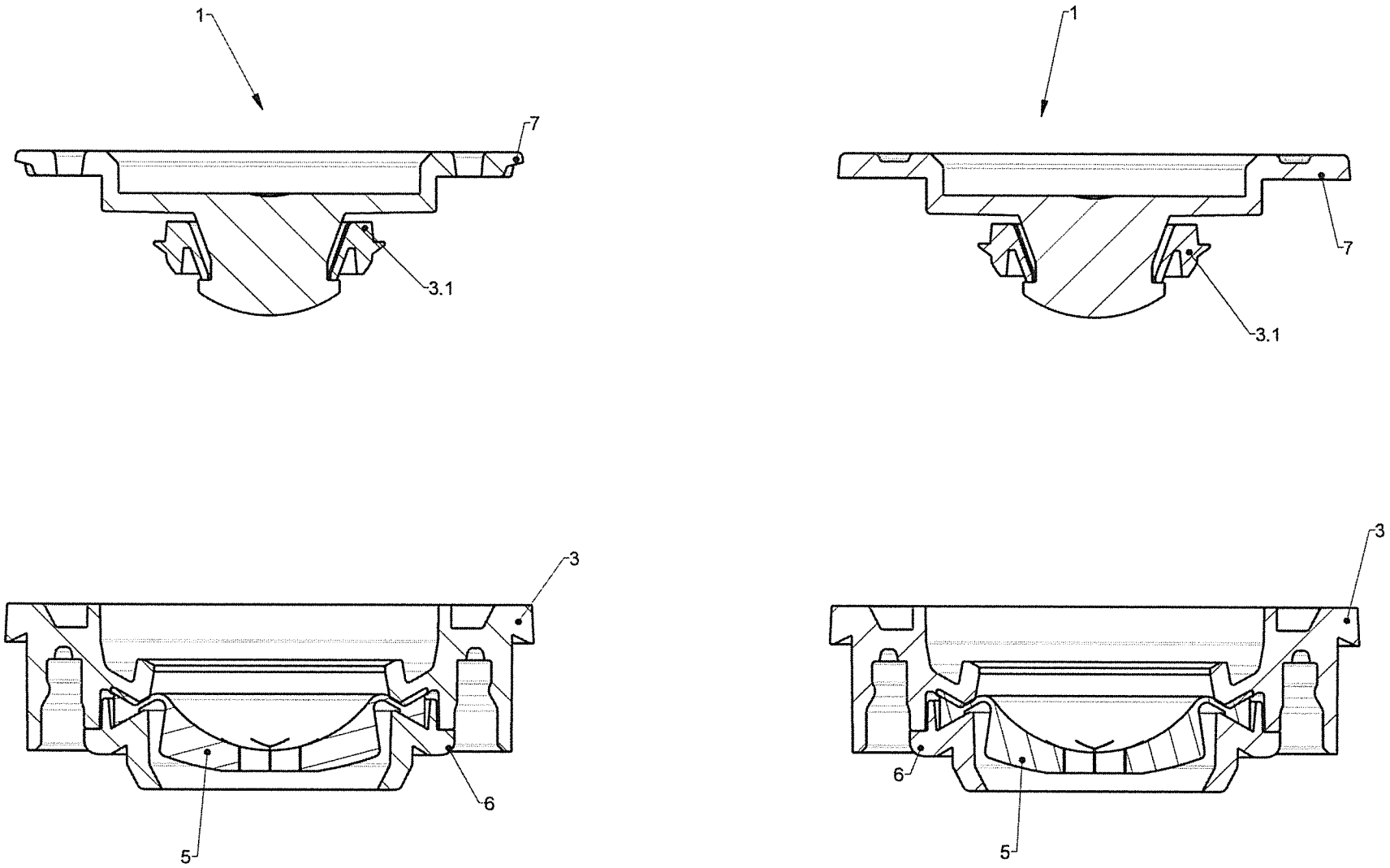
FIG. 14 are two side sectional views of the inventive tap after the removal of the first tamper evident system.

With reference to FIG. 14, the inventive tap 1 is shown, in its configuration without the rear counterfeit-preventing flap.

The pieces are mutually stably/operatively connected in the following way to form the inventive tap 1.

The upper plug 7 with completely flat profile is inserted from the top on the main body 3.

The upper plug 7 is stably constrained with engagement, due to the flexible wings 3.2 of the main body 3, present on the tamper evident ring 3.1, removable when first opening the inventive tap 1, which get stuck with a small plane 7.1 obtained on the central pin 7.4 of the upper plug 7, by being stably constrained and becoming a single piece therewith.

The upper plug 7 performs a static seal due to an internal sealing cylinder 7.9 present on the upper plug 7 coupled with the cylindrical sealing geometry 3.9 present on the main body 3.

Such coupling allows the tap to have a static seal to liquids and protects the internal silicone valve 5 from dust and external treatments (for example, sterilization).

The silicone valve 5 (with a contact surface 5.1) is placed from below, by being inserted into the suitable seat 3.3 created in the lower part of the body 3 according to guidelines required by the manufacturers of these silicone valves, which require that the seat where their valve is placed, must have a particular geometry.

Finally, the lower body 6 is positioned.

Such lower body 6 will be coupled with the body 3 and will be stably constrained thereto, by exploiting one of the known welding technologies (ultrasound or laser or hot blade) present on the market.

Such process firstly allows obtaining a single piece between main body 3 and lower body 6 and moreover allows giving the right sealing pre-load to the silicone valve 5, which, in this way, will perform its sealing to liquids and will be stably coupled with the main body 3.

The upper part 6.7 of the lower body 6, where the silicone valve 5 (with a contact surface 5.4) is placed, operates as lower seat of the silicone valve 5 and always follows the geometric guidelines required by manufacturers of silicone valves.

Always with reference to FIG. 14, it can be noted that the first opening step of the delivering tap 1 consists in the removal of the upper plug 7, which is constrained to the main body 3 by means of the tamper evident ring 3.1 of the body 3 and a small plane 7.1 of the inventive tap, freeing the passage 3.14, which then allow, as described below, the connectors 8 and 9 to reach and be stably connected to the silicone valves 5 present and constrained on the body 3 by means of the lower body 6, allowing the delivery/opening of the valve 5.

The tamper evident ring 3.1 of the main body 3 remains attached to the upper plug 7 due to the flexible wings 3.2 and the small plane 7.1 obtained on the upper plug 2, and gives evidence of opening to the end customer, protecting him from the danger of opening and filling the container (preferably BIB) with counterfeited liquids.

Once having removed the tap, it will be impossible to correctly re-position the ring 3.1 providing an optimum guarantee to the end consumer.

Figure 15:
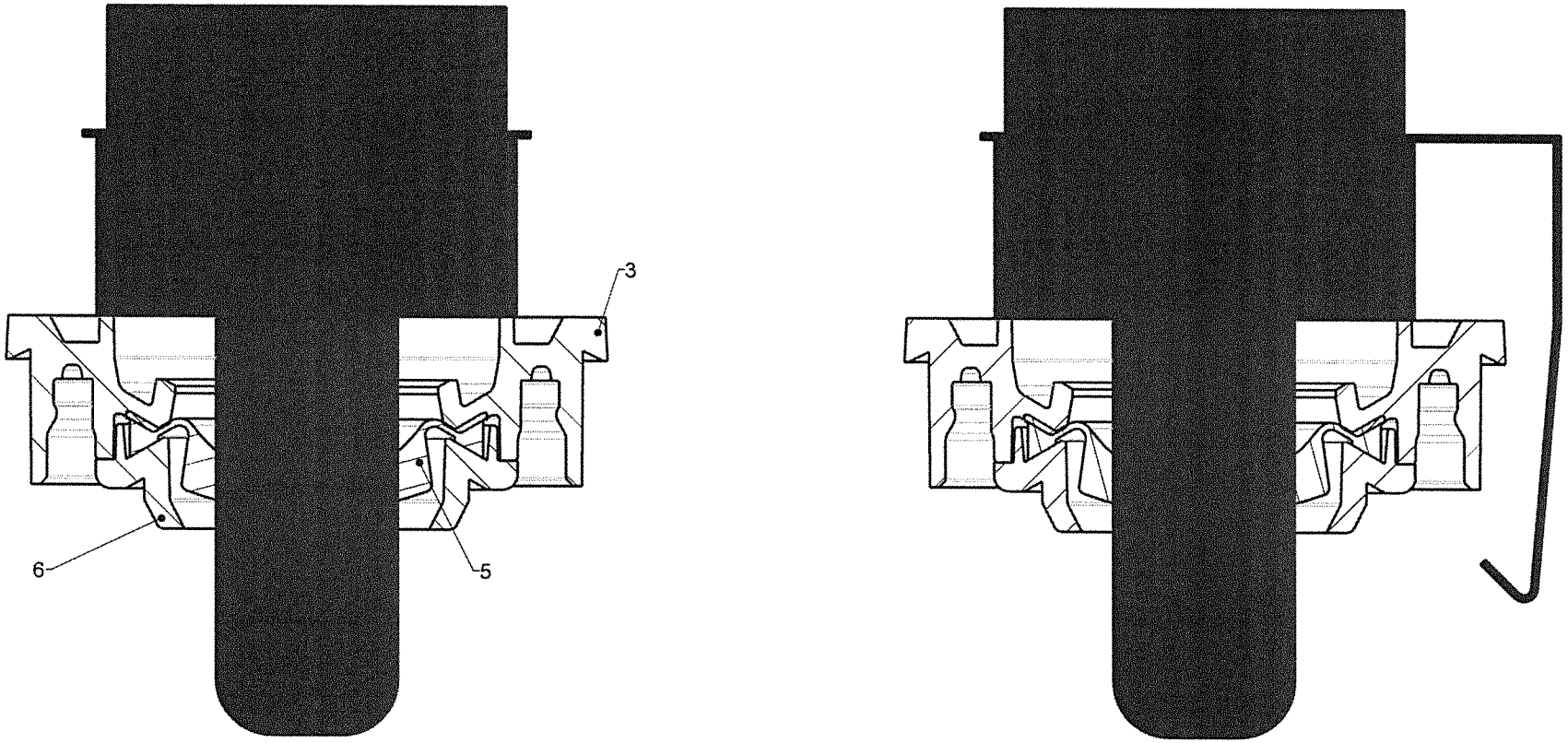
FIG. 15 are two side sectional views of the inventive tap in its completely open position after inserting the pin.
Figure 16:
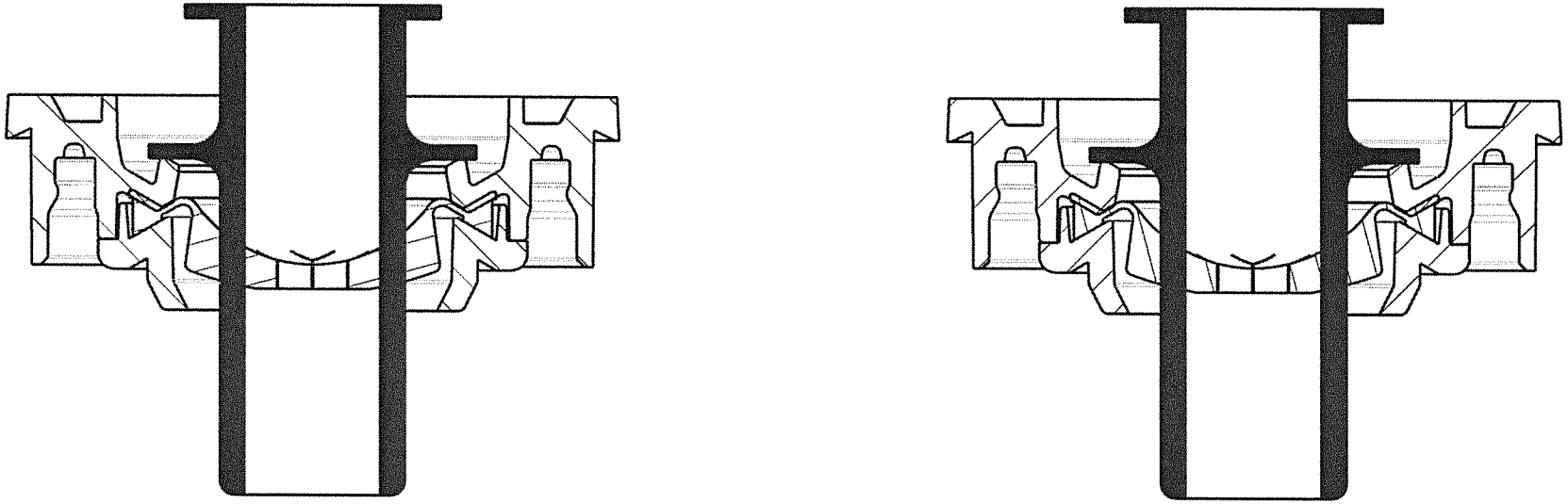
FIG. 16 are two side sectional views of the inventive tap in its completely open position after inserting the pin.

With reference to FIGS. 15 and 16, insertion and activation/opening for delivery of the inventive tap 1 are shown.

Precisely, FIG. 16 shows the insertion of the connector 8 of the Taylor machine 8 (FIG. 24).

In this case, the connection pin 8, Taylor model, penetrates the silicone valve centrally, dilating the through pre-cut 5.2 (FIG. 21) present on the valve itself, and performing a seal on the external diameter 8.1 of the pin 8 (FIG. 24). The pin 8, during the first opening step, pushes when penetrating the silicone valve 5 opening the system.

It will obviously be possible to remove the pin 8, Taylor model, from the inventive tap also when the container is not yet empty, exploiting the self-sealing feature of the silicone valve 5.

Analyzing FIG. 15, the insertion of the connector 9 of the Carpigiani machine (FIG. 23) is shown.

In this case, the connection pin 9, Carpigiani model, penetrates the silicone valve centrally, dilating the through pre-cut 5.2 (FIG. 21) present on the valve itself, and performing a seal on the external diameter 9.1 of the pin 9 (FIG. 24).

It will obviously be possible to remove the pin 9, Carpigiani model, from the inventive tap also when the container is not yet empty, exploiting the self-sealing feature of the silicone valve 5.

The tap 1 of the invention is used for delivering liquids from a container (not shown), and is preferably made as described below.

With reference to FIG. 17, the elongated cylindrical main body 3 preferably comprises, at its upper end, flexible fastening means 3.8 and liquid-sealing means 3.9 obtained thereon. It externally comprises fastening means 3.7 for removing and driving tools present on the filling machines and on the bag-manufacturing machines (in case of BIB). On the upper part of the main body 3, a pushing plane 3.12 is obtained, for the tool which pushes the tap inside the connection mouth to the bag (not shown and only in case of BIB). At the center of the main body 3, there is an integrated tamper evident ring 3.1 connected through jumpers 3.15 which will break when pulled by the tap (2 and 7, depending on the handle configuration which is projecting or plane, as described below).

Inside the tamper evident ring 3.1 there are the flexible fastening means 3.2, which are fastened to the upper plug (2 and 7 depending on the handle configuration which is projecting or plane, as described below). To make the sealing cylinder 3.8 flexible, there is a recess obtained on the upper part 3.4.

At the lower opposite end of the main body 3, it is possible to immediately note the fastening means 3.6 to the mouth (not shown) obtained on a lower external cylinder 3.13. Internally, it is possible to note a material recess 3.10 to make more flexible and enable the insertion of the tap on the external geometries of the mouth (not shown).

On the base of the lower external cylinder 3.13, a chamfer is internally provided, to enable the correct entry of the tap into the connecting mouth, which is not shown in these drawings (and is only valid in case of Bag-in-Box container).

The main body 3 comprises an internal cylinder 3.5 with a connecting surface 3.5, which operates as abutment plane for welding the lower body (4 or 6 depending on the configuration being analyzed) with known welding methods. Internally, it is possible to note the geometries which the manufacturers of silicone valves 5 suggest, and especially the upper chute 3.3 (because the valve is assembled from below). Centrally, it is possible to note the geometries obtained on the removable tamper evident ring 3.1, which fully comply with the requirements of manufacturers of silicone valves 5, especially the curved profile of the jumpers 3.15, which abuts onto the valve compensating possible internal counter-pressures when the tap is being closed (before its first opening) and thereby avoiding that the valve is deformed outwards and therefore loses liquids by being deformed. As can be seen below, this sealing profile is completed by the central internal profile of the tap (2 and 7, depending on the handle configuration which is projecting or plane, as described below).

Figure 18:
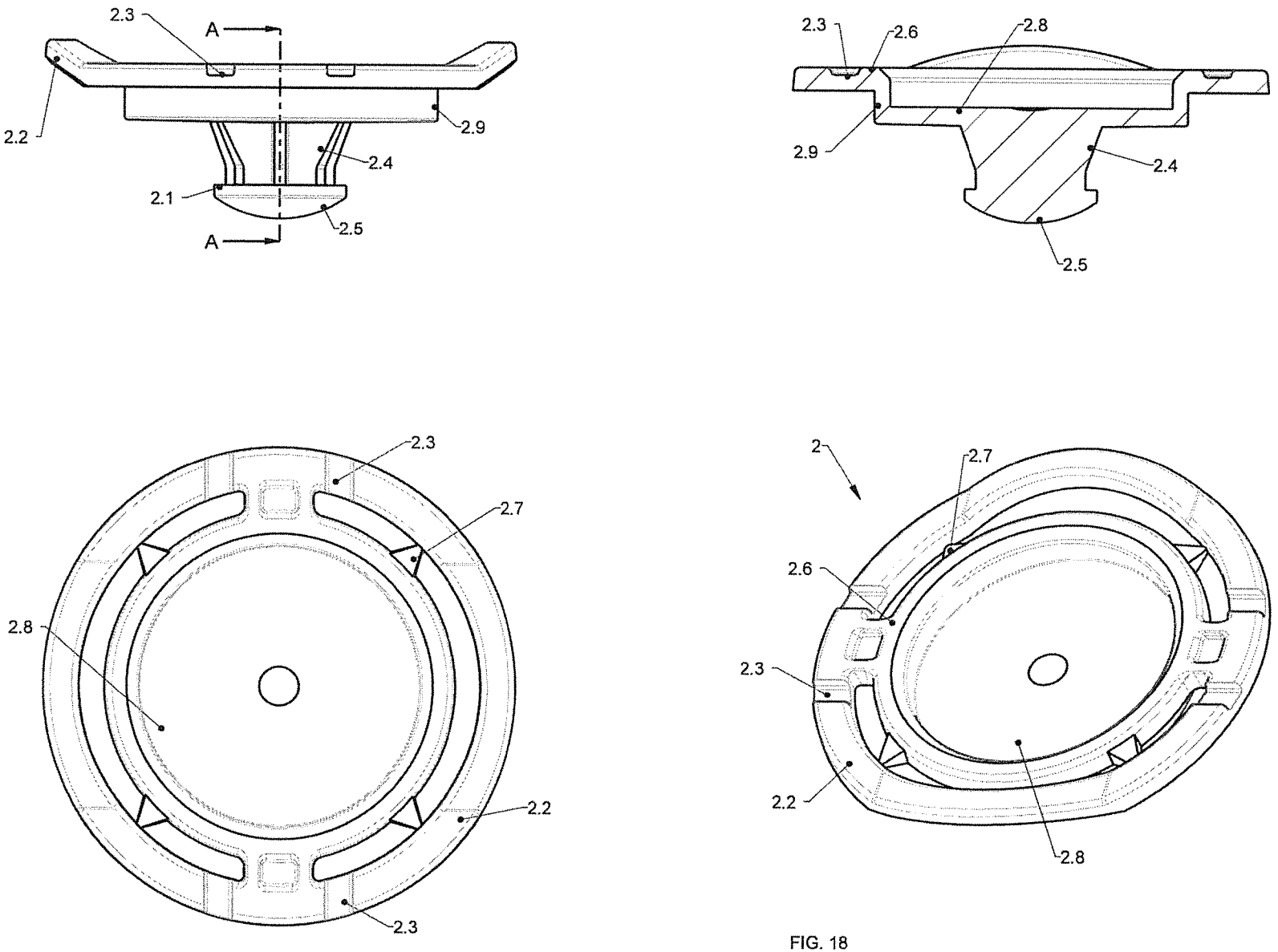
FIG. 18 is a series of views of the cap of the inventive tap.

With reference to FIG. 18, an upper protecting plug is described, with central fastening system to the integrated tamper evident ring present on the body 3 equipped with deformable grasping handles. More precisely, with reference to the drawings, it is possible to note that the tap 2 is equipped with internal sealing means 2.9, for example an internal sealing cylinder 2.9, which actively operate and generate its perfect seal with the cylindrical sealing geometry 3.9 of the body 3. Centrally, it is equipped with a pin 2.4 with the small plane 2.1, which is fastened to the flexible wings 3.2 present inside the tamper evident ring 3.1 (FIG. 17), and once being constrained, they become a single piece with the tap. Once having performed the first opening, the tamper evident ring 3.1 of the body 3 of FIG. 17 gets torn, since it is anchored to the small plane 2.1 of FIG. 18, and provides evidence to the end consumer of an occurred opening, as shown in FIGS. 6 and 14 (depending on the configuration of tap, with or without counterfeit-preventing flap present on the particular lower body 4 or 6). In a preferred way, the upper plug 2 comprises two grasping handles 2.2 connected to a central sealing geometry 2.8 by jumpers 2.7 which break (providing another evidence of opening to the end customer, and therefore a better guarantee) once the two handles are deformed (rotating them both by 90°) to have a stronger grip and enable the removal of the tap and the simultaneous breakage of the tamper evident seal 3.1 connected to the tap 2. Centrally (internally) there is a spherical geometry 2.5, which fully complies, according to requirements of manufacturers of silicone valves 5, with the valve curvature. In this case, the system completes the one described for the tamper evident ring 3.1 in FIG. 17, especially the curved profile 2.5, which abuts onto the valve, compensating possible internal counter-pressures when the tap is being closed (before its first opening) and thereby avoiding that the valve is deformed outwards and therefore loses liquids by being deformed. There further are weakening geometries 2.3, which enable the distortion, and therefore the rotation at 90°, of the two grasping handles of the tap 1.

Figure 22:
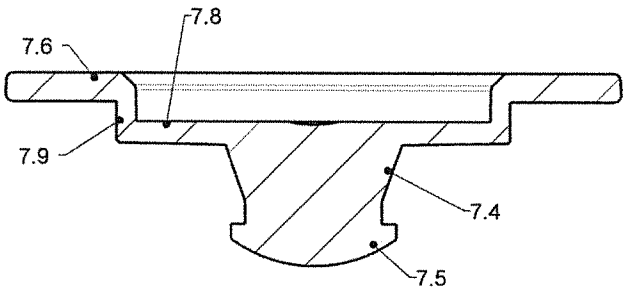
FIG. 22 is a series of views and sections of the upper plug in its completely plate version.
Figure 22:
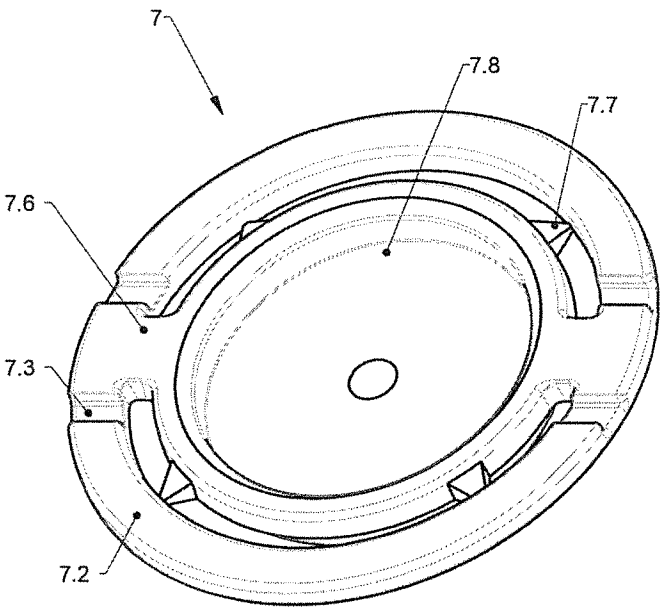
Figure 22:
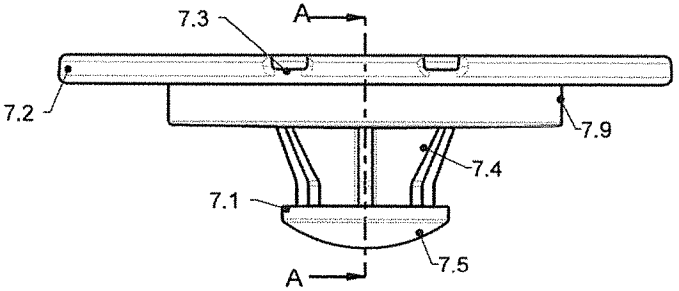
Figure 22:
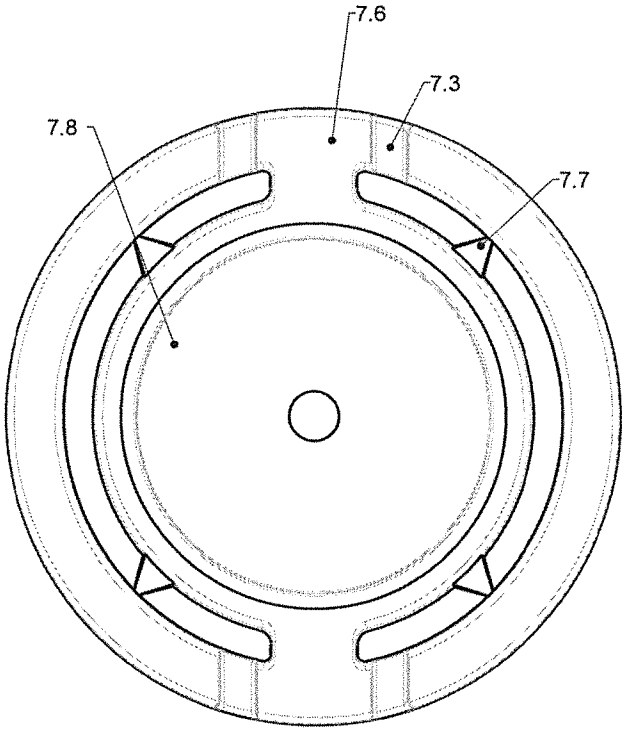

With reference to FIG. 22, an upper protecting plug is shown, with central fastening system to the integrated tamper evident ring present on the body 3 equipped with deformable grasping handles. More precisely, with reference to the drawings, it can be noted that the tap is equipped with an internal sealing cylinder 7.9, which actively operates and determines a perfect seal with the cylindrical sealing geometry 3.9 of the body 3. Centrally, it is equipped with a pin 7.4 with a plane geometry 7.1, which is fastened to the flexible wings 3.2 present inside the tamper evident ring 3.1 (FIG. 17), which, once being constrained, become a single piece with the tap. Once having performed the first opening, the tamper evident ring 3.1 of the body 3 of FIG. 17 gets torn away, since it is anchored to the geometry 7.1 of FIG. 18, and provides evidence to the end consumer of the occurred opening, as shown in FIGS. 6 and 14 (depending on the configuration of tap, with or without counterfeit-preventing flap present on the particular lower body 4 or 6). In a preferred way, the upper plug 7 comprises two grasping handles 7.2 connected to the central sealing geometry 7.8 by jumpers 7.7, which will be broken (providing another evidence of opening to the end customer, and therefore a better guarantee) once the two handles are deformed (by rotating them both by 90°) to have a stronger grip and enable the removal of the tap and the simultaneous breakage of the tamper evident seal 3.1 connected to the tap 2. Centrally (internally) there is a spherical geometry 7.5 which fully complies, according to the requirements of manufacturers of silicone valves 5, with the valve curvature. In this case, the system completes the one described for the tamper evident ring 3.15 (FIG. 17), especially the curved profile 7.5, which abuts onto the valve, compensating possible internal counter-pressures when the tap is being closed (before its first opening), and thereby avoiding that the valve is deformed outwards and therefore loses liquids by being deformed. There further are weakening geometries 7.3 which enable the distortion, and therefore the rotation at 90°, of the two grasping handles of the tap.

With reference to FIG. 21, a silicone valve is shown, with central through notch 5.2 and external fitting flange with upper 5.1 and lower abutting planes 5.4. There are several manufacturers of these type of valves. The first one is company LMS, but there are others. All provide guidelines for creating optimum seats. An important prerogative is that the geometric arrangement of the inventive tap divided into main body 3 and lower body 4 or 6, 8 (which are then mutually welded with widespread and safe methods (hot blade, ultrasound or laser) depending on the configuration required by the customer) enables the chance of reproducing all required seats, and therefore using multiple types of valves. The particular silicone valve will not be dealt with in much detail, since it is peculiar for the present Application to use commercialized valves, and therefore adapt the system of the invention depending on the geometric needs of their manufacturers.

With reference to FIG. 19, it is possible to note the lower body 4 in its arrangement with integrated tamper-preventing flap, open in its molding position.

This is an optional part which, according to the specific request of a customer, can provide the inventive tap 1 with a supplementary rear counterfeit-preventing system, in addition to those already described before, which opens only when it penetrates into the pin 8, Taylor model, or the pin 9, Carpigiani model, or with any other type of pushing pin (not shown) present on the market, at its first opening.

The lower body with integrated flap 4 is formed of a main body, on which the geometries 4.7 are obtained, necessary and required for the right placement of the silicone valve 5 (always suggested by the manufacturer of silicone valves 5) and possibly a centering cylinder of the piece 4.6, considering that the lower body is inserted from below as last part, and then welded to the main body 3 according to known welding methods (hot blade, laser or ultrasound).

It is possible to note the welding plane 4.5, on which energy addressing devices (not shown) can be obtained, to improve the welding.

On the lower part of the piece, it is possible to note the geometries 4.16 useful to contain the distortion of the silicone valve 5 during the penetration by the pin 8 and/or 9.

The arrangement of the external walls 4.10 and of the chute 4.9 enable the entry of the tap once having completely assembled it in the mouth (not shown).

The curved geometry 4.11 generates the static seal of the piece, and therefore its counterfeit-preventing feature when it cooperates with the recesses 4.2 of the flap 4.1, as shown in FIG. 6.

There will be a bending hinge 4.13, which connects in a single piece the body to the flap 4.1. Connecting elements 4.12 4.14 enable and correctly and simply guide the closure of the flap.

On the flap 4.1, connected to the hinge 4.13 and consequently to the body 8 (everything will be a single piece obtained with the injection molding technique), there will be geometries to enable the entry of the tap 4.4 and 4.2 and a small stopper plane 4.3.

In order to stiffen the structure, a cross with ribs 4.15 is made.

With reference to FIG. 20, it is possible to note the lower body 6 in its arrangement without the integrated counterfeit-preventing flap.

This is the second possible configuration making part of the tap of the invention, which, according to the specific request of a customer, can provide the inventive tap 1 with a supplementary counterfeit-preventing system, with or without flap.

The lower body without integrated flap 6 is formed of a main body on which the geometries 6.7 are obtained, necessary and required for the right placement of the silicone valve 5 (always suggested by the manufacturers of silicone valves 5) and possibly a centering cylinder of the piece 6.6, considering that the lower body is inserted from below as last part and then welded to the main body 3 according to known welding methods (hot blade, laser or ultrasound).

It is possible to note the welding plane 6.5, on which energy addressing devices (not shown) can be obtained, to improve the welding.

On the lower part of the piece, it is possible to note the geometries 6.11 useful to contain the distortion of the silicone valve 5 during the penetration by the pin 8 and/or 9.

The arrangement of the external walls 6.10 and the chute 6.9 enables the entry of the tap, once it is completely assembled in the mouth (not shown).

The invention claimed is:

1. A tap for delivering liquids, comprising:

a main body configured to be placed at a delivery end of a container;

a valve inserted between a lower fastening body and the main body, the valve comprising slits configured to ensure an air-tightness allowing liquids to pass only when opening the tap;

the lower fastening body, configured to block the valve and allow the valve to correctly open, fastened to a lower side of the main body, configured to be placed on the delivery end of the container; and an upper plug or cap placed over the main body; wherein:

the main body includes a tamper evident warranty ring integrated and removable when first opening the tap; and the upper plug is assembled on the main body and anchored to the warranty ring integrated in the main body.

2. The tap of claim 1, wherein the upper plug comprises a central pin configured to be inserted and be fastened in the warranty ring integrated in the main body to stably assemble the upper plug to the main body to the first opening of the tap.

3. The tap of claim 2, wherein the central pin comprises a small plane and the warranty ring comprises fastening means, the small plane being configured to be fastened to the fastening means.

4. The tap of claim 1, wherein the upper plug comprises internal sealing means and the main body comprises a cylindrical sealing geometry, the internal sealing means and cylindrical sealing geometry being sealing coupled to obtain a static seal to liquids and protect the valve.

5. The tap of claim 1, wherein the valve is inserted in a circular seat created in the lower part of the main body, with a surface in contact with the circular seat.

6. The tap of claim 1, wherein the lower fastening body comprises an upper surface which operates as lower seat in which the valve is placed, comprising a contact surface with the upper surface.

7. The tap of claim 1, wherein the main body comprises an internal cylinder with a connecting surface configured for operating as abutment plane for welding the lower fastening body, and the lower fastening body comprises a profile useful for welding the main body.

8. The tap of claim 1, wherein the main body comprises a first threading and the lower fastening body comprises a second threading, the first threading and the second threading being configured to be mutually screwed for screwing the main body and the lower fastening body.

9. The tap of claim 1, wherein the lower fastening body comprises a tamper-preventing flap inserted inside a seat of the lower fastening body, bent by following specific guiding geometries which connect the tamper-prevention flap to the lower fastening body.

10. The tap of claim 1, wherein the upper plug comprises grasping handles and a central sealing geometry connected by jumpers configured for being broken, providing evidence of opening, once the handles are deformed to have a stronger grip and enable the removal of the upper plug and the simultaneous breakage of the warranty ring connected to the upper plug.

11. The tap of claim 1, wherein the upper plug comprises a spherical geometry configured to be coupled with a curvature of the valve compensating possible counter-pressures inside the tap, avoiding that the valve is deformed outwards and loses liquids by being deformed.

* * * * *